US009283491B2

(12) United States Patent
Pope-Gusev

(10) Patent No.: US 9,283,491 B2
(45) Date of Patent: Mar. 15, 2016

(54) KIT FOR CONSTRUCTING A PLAY STRUCTURE

(71) Applicant: Fort Magic, LLC, Sarasota, FL (US)

(72) Inventor: Erika Pope-Gusev, Osprey, FL (US)

(73) Assignee: Fort Magic, LLC, Sarasota, FL (US)

( * ) Notice: Subject to any disclaimer, the term of this patent is extended or adjusted under 35 U.S.C. 154(b) by 0 days.

(21) Appl. No.: 14/202,065

(22) Filed: Mar. 10, 2014

(65) Prior Publication Data

US 2014/0187117 A1 Jul. 3, 2014

Related U.S. Application Data

(63) Continuation-in-part of application No. 13/298,387, filed on Nov. 17, 2011, now Pat. No. 8,708,765.

(51) Int. Cl.

| | |
|---|---|
| ***A63H 33/00*** | (2006.01) |
| ***A63H 33/10*** | (2006.01) |
| *A63H 17/00* | (2006.01) |

(52) U.S. Cl.

CPC ..... *A63H 33/101* (2013.01); *A63H 33/008* (2013.01); *A63H 33/102* (2013.01); *Y10T 29/49826* (2015.01)

(58) Field of Classification Search

CPC ... A63H 17/00; A63H 17/002; A63H 17/045; A63H 17/26; A63H 33/00; A63H 3/36

USPC ..... 446/85, 93–95, 97–99, 124, 126; 52/2.13, 2.18, 2.22; 108/101, 92

See application file for complete search history.

(56) References Cited

U.S. PATENT DOCUMENTS

| | | | | |
|---|---|---|---|---|
| 2,023,939 A | | 12/1935 | Talmadge | |
| 2,281,792 A | | 5/1942 | Ott | |
| 2,709,318 A | | 5/1955 | Benjamin | |
| 3,176,428 A | | 4/1965 | Slingluff | |
| 3,314,551 A | * | 4/1967 | Plastow | E04H 1/1272 160/231.2 |
| 3,648,404 A | | 3/1972 | Ogsbury et al. | |
| 3,747,262 A | | 7/1973 | Endres | |
| 3,796,004 A | | 3/1974 | Auerbach | |

(Continued)

FOREIGN PATENT DOCUMENTS

EP 2457628 A1 5/2012

OTHER PUBLICATIONS http:/www.kickstarter.com/projects/effalo/domekitcc-domes-for-all; Dec. 18, 2013.

*Primary Examiner* — Kien Nguyen

(74) *Attorney, Agent, or Firm* — Fraser Clemens Martin & Miller LLC; William A. Ziehler

(57) ABSTRACT

A kit for constructing a variety of play structures for children includes a plurality of arcuate tubes, a plurality of linear tubes, a plurality of connectors, a plurality of couplers, and a plurality of panels. At least one of the tubes is releasably assembled together with another one of the tubes using one of the couplers and the connectors to form a frame. The frame may also include at least one panel releasably coupled to at least one of the couplers. An instruction manual provides directions for releasably assembling the tubes, the connectors, the couplers, and the panels to form the variety of play structures from the kit. The kit may also include at least one covering and at least one covering connector to releasably affix the covering to at least a portion of the frame of the play structure.

33 Claims, 23 Drawing Sheets

(56) References Cited

U.S. PATENT DOCUMENTS

| | | | | | |
|---|---|---|---|---|---|
| 3,856,241 | A | | 12/1974 | Kupperman et al. | |
| 3,871,143 | A | | 3/1975 | Quick | |
| 3,873,220 | A | | 3/1975 | Kashiwabara | |
| 3,896,743 | A | * | 7/1975 | Pariente | A47B 47/00 108/156 |
| 3,948,471 | A | | 4/1976 | Pearce et al. | |
| 3,962,827 | A | | 6/1976 | Chaffee | |
| 4,078,328 | A | | 3/1978 | Rayment | |
| 4,129,975 | A | | 12/1978 | Gabriel | |
| 4,170,082 | A | | 10/1979 | Freedman | |
| 4,251,106 | A | | 2/1981 | Gilbert | |
| 4,259,790 | A | | 4/1981 | Borisof | |
| 4,302,900 | A | | 12/1981 | Rayner | |
| 4,494,558 | A | | 1/1985 | Fidler, Jr. | |
| 4,715,564 | A | | 12/1987 | Kinn et al. | |
| 4,846,078 | A | * | 7/1989 | Janson | A47B 96/145 108/101 |
| 4,974,986 | A | | 12/1990 | Cook | |
| 5,265,557 | A | | 11/1993 | Lovitz | |
| 5,282,767 | A | | 2/1994 | Gelardi | |
| 5,318,470 | A | | 6/1994 | Denny | |
| 5,480,336 | A | | 1/1996 | Blanchard | |
| 5,487,690 | A | | 1/1996 | Stoffle et al. | |
| 5,487,691 | A | | 1/1996 | Chiu | |
| 5,690,446 | A | | 11/1997 | Poissant et al. | |
| 5,761,852 | A | | 6/1998 | Liu | |
| 5,779,240 | A | | 7/1998 | Santella | |
| 5,785,447 | A | * | 7/1998 | Fonti et al. | 403/49 |
| 5,830,032 | A | | 11/1998 | Campbell | |
| 5,934,563 | A | | 8/1999 | Gapco | |
| 6,050,872 | A | | 4/2000 | Cahill et al. | |
| 6,220,180 | B1 | * | 4/2001 | Janowitz | A47B 21/00 108/101 |
| 6,223,757 | B1 | | 5/2001 | Horvath et al. | |
| 6,468,128 | B1 | | 10/2002 | Bala et al. | |
| 6,491,563 | B1 | | 12/2002 | Bailey | |
| 6,641,453 | B1 | | 11/2003 | Morales et al. | |
| 6,669,526 | B2 | | 12/2003 | Manville et al. | |
| 6,752,729 | B1 | * | 6/2004 | Huang | 473/476 |
| 7,316,598 | B1 | | 1/2008 | Lock | |
| 7,374,468 | B2 | | 5/2008 | Flodin et al. | |
| 7,784,232 | B2 | | 8/2010 | Nygren et al. | |
| 7,987,533 | B2 | | 8/2011 | Phipps et al. | |
| 8,037,906 | B1 | | 10/2011 | Grillo | |
| 8,408,962 | B2 | | 4/2013 | Sambenedetto | |
| 8,499,492 | B2 | * | 8/2013 | Kassouni | 47/45 |
| 2007/0178799 | A1 | | 8/2007 | Rudell et al. | |
| 2008/0090486 | A1 | | 4/2008 | Zawitz | |
| 2008/0121309 | A1 | | 5/2008 | Boise et al. | |
| 2009/0272415 | A1 | | 11/2009 | Zepeda | |
| 2010/0130094 | A1 | | 5/2010 | Michalk et al. | |
| 2010/0285718 | A1 | | 11/2010 | Stone et al. | |
| 2010/0288320 | A1 | | 11/2010 | Rehkemper | |

* cited by examiner

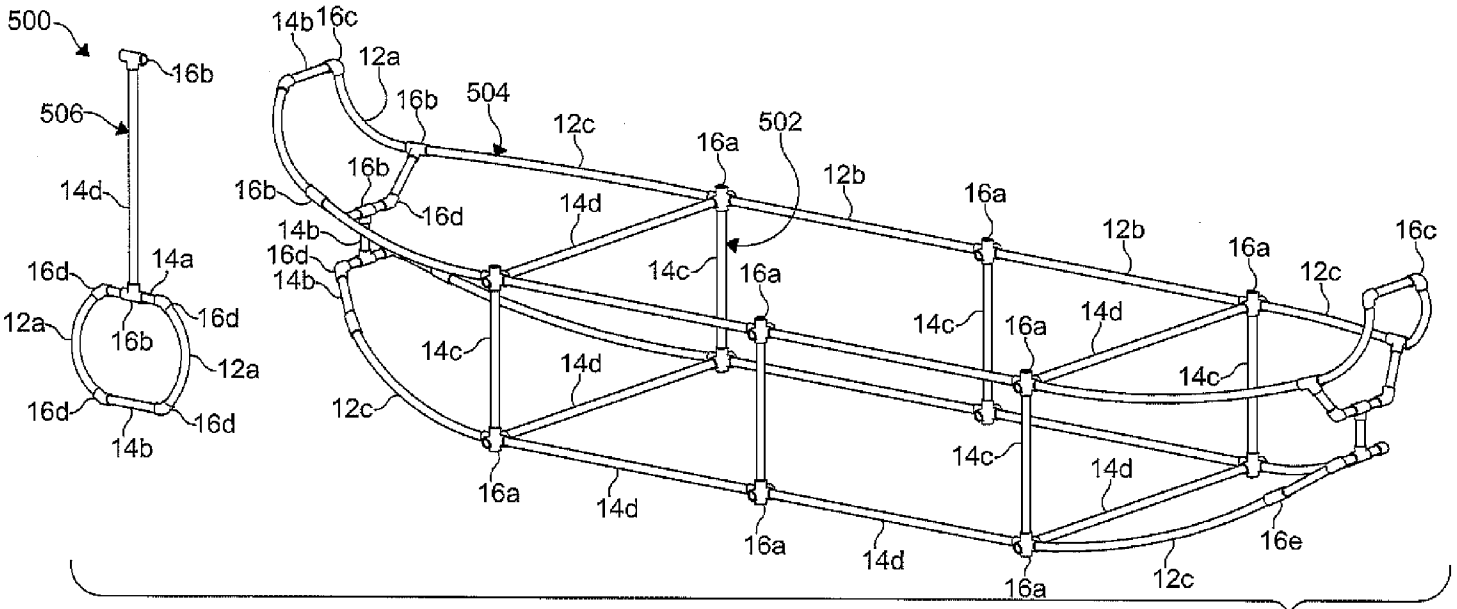
500
506
14d
16b
14a
16d
12a
16d
14b
16b
16d
12a
16d
14b
16d
14b
16b
16c
14b
12a
16b
504
12c
14d
14d
14d
14c
14c
14c
14c
16a
16a
16a

KIT FOR CONSTRUCTING A PLAY STRUCTURE

CROSS-REFERENCE TO RELATED APPLICATIONS

This application is a continuation-in-part of U.S. patent application Ser. No. 13/298,387 filed Nov. 17, 2011, the entire disclosure of which is incorporated herein by reference.

FIELD OF THE INVENTION

The invention relates generally to a kit for children. More particularly, the invention relates to a kit for constructing a variety of play structures for children.

BACKGROUND OF THE INVENTION

Play structures for small play or action figures are well known. Typically, the play structures have a central theme such as a barn, house or cave, and are relatively small enclosed structures. The size of a typical play structure is generally such that small children may insert their hands, together with a play or action figure into the play structure. In addition to being relatively small and having limited access to the interior, such play structures are typically rather intricate and difficult to assemble.

Larger play structures are generally a cross-section of a structure such as a house, wherein children can play with small play or action figures either on the outside facade of the structure of in the interior cut-away. Another type of the larger play structures allows the children to enter and exit an interior space of the play structure. However, these larger play structures are typically assembled from large injection molded panels which are heavy, awkward to handle, and not easily assembled and disassembled.

It would be desirable to develop a kit for constructing a variety of play structures for children. Each of the play structures would advantageously permit both imaginative, interactive play with the play structure and role playing by a child inside the play structure itself. Additionally, each of the play structures and play surfaces may both incorporate features having a single, central theme.

SUMMARY OF THE INVENTION

In concordance and agreement with the present invention, a kit which can be releasably assembled into at least one play structure for children, wherein the play structure permits both imaginative, interactive play with the play structure and role playing by a child inside the play structure itself, has surprisingly been discovered.

In one embodiment, an accessory kit for constructing a variety of play structures for a child comprises: a plurality of panels, the plurality of panels including a first panel having a non-linear edge. The accessory kit also includes a plurality of couplers, the plurality of couplers including a first coupler having a C-shaped tube clip formed in a first end thereof. The C-shaped tube clip has a C-shaped channel formed therein configured to releasably couple the first coupler to an exterior surface of a tube, wherein a second end of the first coupler extends away from the C-shaped tube clip in a direction perpendicular to a direction the C-shaped channel extends through the C-shaped tube clip.

In another embodiment, a kit for constructing a variety of play structures for a child comprises a plurality of arcuate first tubes and a plurality of arcuate second tubes, wherein at least one of the arcuate first tubes and the arcuate second tubes is substantially rigid. The kit further comprises a plurality of linear tubes, wherein the linear tubes are substantially rigid, and a plurality of connectors. The connectors include a 6-way tube connector, a 3-way tube connector, a 90-degree tube connector, a 45-degree tube connector, and a coupling tube connector, the connectors configured for releasably assembling at least one of the arcuate first tubes, the arcuate second tubes, and the linear tubes together with another one of the arcuate first tubes, the arcuate second tubes, and the linear tubes to form a variety of frames for the variety of play structures. The kit also comprises a plurality of panels, the plurality of panels including a first panel having a non-linear edge. The kit also comprises a plurality of couplers, the plurality of couplers including a first coupler having a C-shaped tube clip formed in a first end thereof, the C-shaped tube clip having a C-shaped channel formed therein configured to releasably couple the first coupler to an exterior surface of one of the arcuate first tubes, the arcuate second tubes, and the linear tubes. A second end of the first coupler extends away from the C-shaped tube clip in a direction perpendicular to a direction the C-shaped channel extends through the C-shaped tube clip. At least one of the frames is configured to fit the child inside the frame.

The invention also includes a method of constructing a play structure.

The method comprises the steps of: providing a kit including a plurality of arcuate first tubes, a plurality of arcuate second tubes, wherein at least one of the arcuate first tubes and the arcuate second tubes is substantially rigid, and a plurality of linear tubes, wherein the linear tubes are substantially rigid; providing an accessory kit including a plurality of panels and a plurality of couplers, the plurality of panels including a first panel having a non-linear edge and the plurality of couplers including a first coupler having a C-shaped tube clip formed in a first end thereof, the C-shaped tube clip having a C-shaped channel formed therein configured to releasably couple the first coupler to an exterior surface of one of the arcuate first tubes, the arcuate second tubes, and the linear tubes, wherein a second end of the first coupler extends away from the C-shaped tube clip in a direction perpendicular to a direction the C-shaped channel extends through the C-shaped tube clip; releasably assembling at least one of the arcuate first tubes, the arcuate second tubes, and the linear tubes together with another one of the arcuate first tubes, the arcuate second tubes, and the linear tubes to form a frame of the play structure; and releasably coupling the first coupler to at least one of the arcuate first tubes, the arcuate second tubes, and the linear tubes.

BRIEF DESCRIPTION OF THE DRAWINGS

The above, as well as other objects and advantages of the invention, will become readily apparent to those skilled in the art from reading the following detailed description of various embodiments of the invention when considered in the light of the accompanying drawings in which:

FIG. 10 is a perspective view of a pair of play structures constructed from the kit illustrated in FIG. 1, wherein one of the play structures has a canoe-shaped configuration and another of the play structures has a paddle-shaped configuration;

FIG. 11 is a perspective view of the canoe-shaped play structure of FIG. 10 having a covering disposed on at least a portion thereof;

DETAILED DESCRIPTION OF EXEMPLARY EMBODIMENTS OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
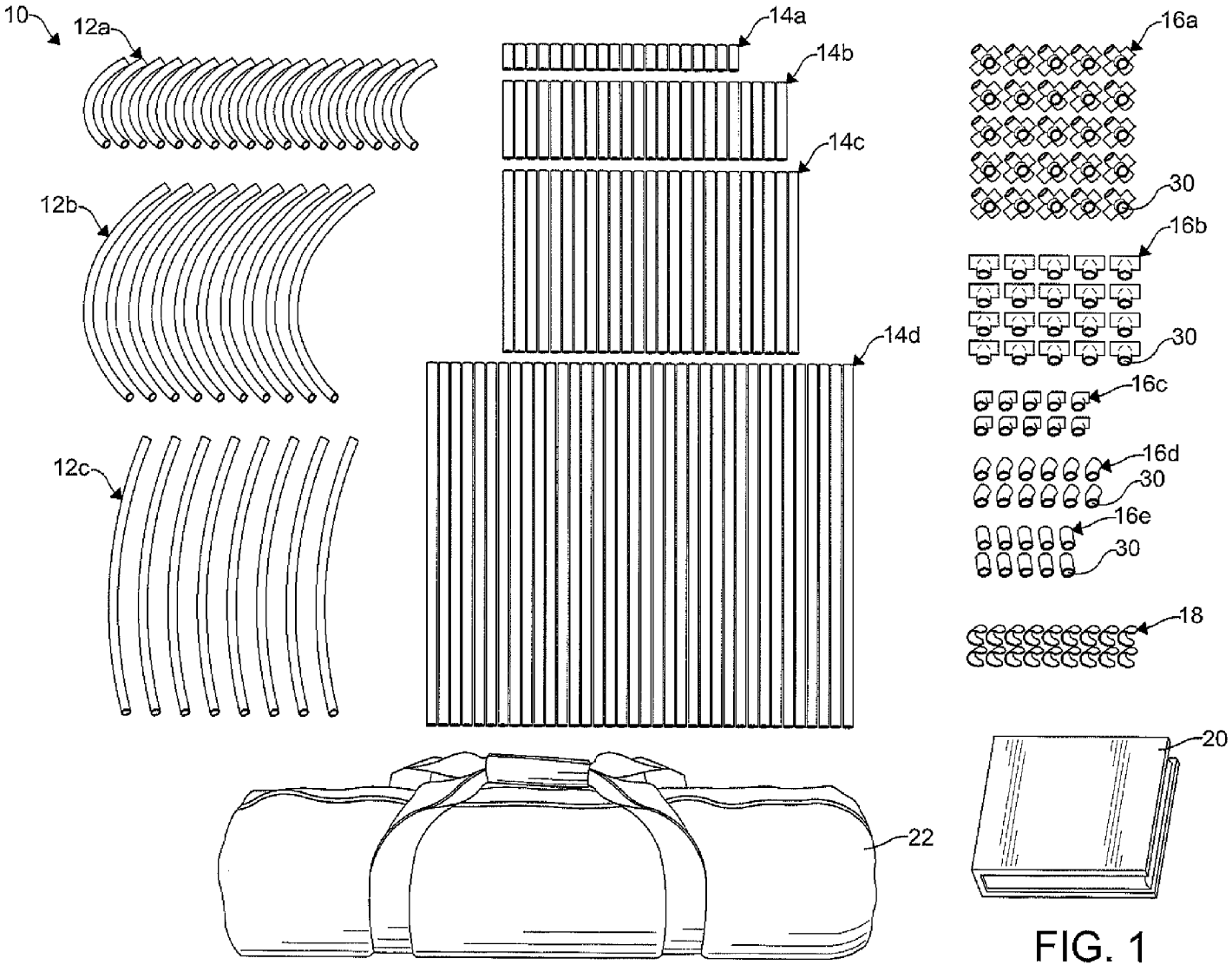
FIG. 1 is a perspective view of a kit for constructing at least one play structure for children according to an embodiment of the present invention.

FIG. 1 shows a kit 10 for constructing at least one play structure 100, 100', 200, 200', 300, 300', 400, 400', 500, 500', 600, 600', 700, 700', 800, 800', 900, 900', 1000, 1100 (shown in FIGS. 2-21) for children according to the present invention. The play structures 100, 100', 200, 200', 300, 300', 400, 400', 500, 500' are transportation vehicle-shaped configurations, the play structures 600, 600', 700, 700' are building-shaped configurations, and the play structures 800', 900, 900', 1000 are animal-shaped configurations. It is understood that the kit 10 can be used to construct play structures other than the play structures 100, 100', 200, 200', 300, 300', 400, 400', 500, 500', 600, 600', 700, 700', 800, 800', 900, 900', 1000, 1100 described hereinbelow. For example, the kit 10 can be used to construct a play structure having other building-shaped configurations such as a horse barn-shaped configuration and a play house-shaped configuration, for example; other animal-shaped configurations such as a dragon-shaped configuration, a knight-shaped configuration, a unicorn-shaped configuration, a Pegasus-shaped configuration, a sea monster-shaped configuration, and an alien-shaped configuration, for example; and other transportation vehicle-shaped configurations such as an unidentified flying object (UFO)-shaped configuration, a space ship-shaped configuration, a hot air balloon-shaped configuration, a tank-shaped configuration, a Hummer®-shaped configuration, a fire truck-shaped configuration, a covered wagon-shaped configuration, and the like, for example.

The kit 10 shown includes a plurality of arcuate first tubes 12*a*, a plurality of arcuate second tubes 12*b*, a plurality of arcuate third tubes 12*c*, a plurality of linear fourth tubes 14*a*, a plurality of linear fifth tubes 14*b*, a plurality of linear sixth tubes 14*c*, a plurality of linear seventh tubes 14*d*, a plurality of 6-way tube connectors 16*a*, a plurality of 3-way tube connectors 16*b*, a plurality of 90-degree tube connectors 16*c*, a plurality of 45-degree tube connectors 16*d*, a plurality of coupling tube connectors 16*e*, a plurality of covering connectors 18, an instruction manual 20, and a carrying bag 22. It is understood that the instruction manual 20 provides directions such as written descriptions and/or diagrams, for example, showing how to construct each of the play structures 100, 100', 200, 200', 300, 300', 400, 400', 500, 500', 600, 600', 700, 700', 800, 800', 900, 900', 1000, 1100 so that adults and/or children can use the kit 10. The tubes 12*a*, 12*b*, 12*c*, 14*a*, 14*b*, 14*c*, 14*d* and connectors 16*a*, 16*b*, 16*c*, 16*d*, 16*e*, 18 are substantially rigid and can have a distinct color to assist in assembling the play structures 100, 100', 200, 200', 300, 300', 400, 400', 500, 500', 600, 600', 700, 700', 800, 800', 900, 900', 1000, 1100 according to the instruction manual 20.

In a non-limiting example, the kit 10 includes eighteen (18) of the first tubes 12*a*, ten (10) of the second tubes 12*b*, eight (8) of the third tubes 12*c*, twenty (20) of the fourth tubes 14*a*, twenty-four (24) of the fifth tubes 14*b*, twenty-five (25) of the sixth tubes 14*c*, thirty-six (36) of the seventh tubes 14*d*, twenty-five (25) of the 6-way tube connectors 16*a*, twenty (20) of the 3-way tube connectors 16*b*, ten (10) of the 90-degree tube connectors 16*c*, twelve (12) of the 45-degree tube connectors 16*d*, ten (10) of the coupling tube connectors 16*e*, and one hundred thirty (130) of the covering connectors 18. Additional or fewer tubes 12*a*, 12*b*, 12*c*, 14*a*, 14*b*, 14*c*, 14*d* and connectors 16*a*, 16*b*, 16*c*, 16*d*, 16*e*, 18 than shown can be included in the kit 10 if desired. It is understood, however, a number and a variety of play structures which can be constructed from the kit 10 depends on the number of each of the tubes 12*a*, 12*b*, 12*c*, 14*a*, 14*b*, 14*c*, 14*d* and connectors 16*a*, 16*b*, 16*c*, 16*d*, 16*e*, 18 included in the kit 10.

In the embodiment shown, each of the first tubes 12*a* has an arc length in a range of about 8 inches to about 10 inches and an angle of curvature of about 90 degrees. In a non-limiting example, the arc length of each of the first tubes 12*a* is about 9.4 inches. Accordingly, four of the first tubes 12*a* assembled together form a circle having a diameter in a range of about 10 inches to about 14 inches. Each of the second tubes 12*b* has an arc length in a range of about 17 inches to about 20 inches and an angle of curvature of about 90 degrees. In a non-limiting example, the arc length of each of the second tubes 12*b* is about 18.8 inches. Accordingly, four of the second tubes 12*b* assembled together form a circle having a diameter in a range of about 22 inches to about 26 inches. Each of the third tubes 12*c* has an arc length in a range of about 17 inches to about 20 inches and an angle of curvature of about 45 degrees. In a non-limiting example, the arc length of each of the third tubes 12*c* is about 18.8 inches. According, eight of the third tubes

12*c* assembled together form a circle having a diameter of about 46 inches to about 50 inches.

In the embodiment shown, each of the fourth tubes 14*a* has a length in a range of about 1 inch to about 4 inches. In a non-limiting example, the length of each of the fourth tubes 14*a* is about 2 inches. Each of the fifth tubes 14*b* has a length in a range of about 3 inches to about 7 inches. In a non-limiting example, the length of each of the fifth tubes 14*b* is about 5 inches. Each of the sixth tubes 14*c* has a length in a range of about 10 inches to about 14 inches. In a non-limiting example, the length of each of the sixth tubes 14*c* is about 12 inches. Each of the seventh tubes 14*d* has a length in a range of about 22 inches to about 26 inches. In a non-limiting example, the length of each of the seventh tubes 14*d* is about 24 inches.

As commonly known, the 6-way connector 16*a* includes a pair of openings 30 formed along three separate axes (i.e. x, y, z), the 3-way connector 16*b* includes a pair of openings 30 formed along one axis and an opening 30 formed along a separate, perpendicular axis, the 90-degree connector 16*c* includes a pair of openings 30 formed at 90 degrees in respect of one another, the 45-degree connector 16*d* includes a pair of openings 30 formed at 45 degrees in respect of one another, and the coupling connector 16*e* includes a pair of opening 30 formed at 180 degrees in respect of one another.

Each of the connectors 16*a*, 16*b*, 16*c*, 16*d*, 16*e* receives at least one of the tubes 12*a*, 12*b*, 12*c*, 14*a*, 14*b*, 14*c*, 14*d* therein. To releasably assemble the tubes 12*a*, 12*b*, 12*c*, 14*a*, 14*b*, 14*c*, 14*d* with the connectors 16*a*, 16*b*, 16*c*, 16*d*, 16*e*, an end of each of the tubes 12*a*, 12*b*, 12*c*, 14*a*, 14*b*, 14*c*, 14*d* is inserted into one of the openings 30 formed in one of the connectors 16*a*, 16*b*, 16*c*, 16*d*, 16*e* using an axial movement in respect of the axis of the tube 12*a*, 12*b*, 12*c*, 14*a*, 14*b*, 14*c*, 14*d* in a first direction towards the respective connector 16*a*, 16*b*, 16*c*, 16*d*, 16*e* and a rotational movement in a first direction (i.e. clockwise). To disassemble the tubes 12*a*, 12*b*, 12*c*, 14*a*, 14*b*, 14*c*, 14*d* with the connectors 16*a*, 16*b*, 16*c*, 16*d*, 16*e*, each of the tubes 12*a*, 12*b*, 12*c*, 14*a*, 14*b*, 14*c*, 14*d* is removed from the opening 30 formed in one of the connectors 16*a*, 16*b*, 16*c*, 16*d*, 16*e* using an axial movement in respect of the axis of the tube 12*a*, 12*b*, 12*c*, 14*a*, 14*b*, 14*c*, 14*d* in an opposite second direction away from the respective connector 16*a*, 16*b*, 16*c*, 16*d*, 16*e* and a rotational movement in an opposite second direction (i.e. counter-clockwise).

The kit 10 may also include at least one covering 24 (shown in FIGS. 3, 5, 7, 9, 11, 13, 15, 17, 19). Each of the play structures 100', 200', 300', 400', 500', 600', 700', 800', 900' includes the at least one covering 24 to enhance imaginative, interactive play of a child with the play structure and role playing by the child inside the play structure itself.

Figure 2:
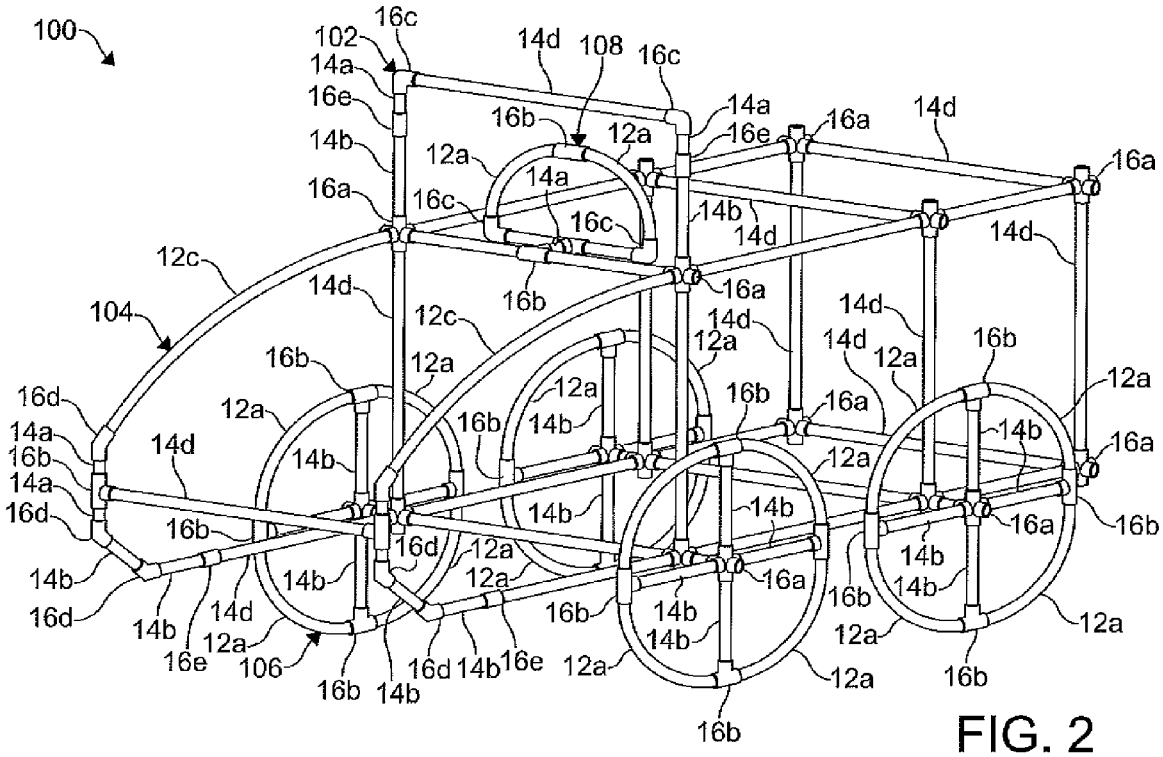
FIG. 2 is a perspective view of a play structure constructed from the kit illustrated in FIG. 1, wherein the play structure has an automobile-shaped configuration.
Figure 3:
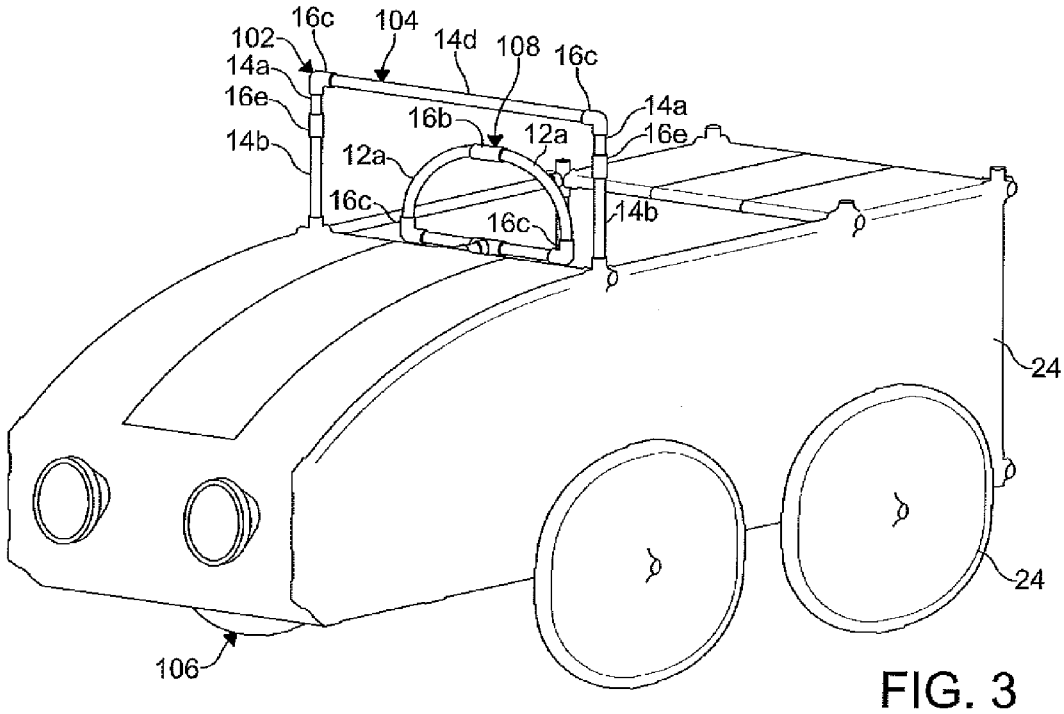
FIG. 3 is a perspective view of the play structure of FIG. 2 having a covering disposed on at least a portion thereof.

FIGS. 2-3 show the kit 10 releasably assembled to construct the play structures 100, 100' having an automobile-shaped configuration. In certain embodiments, each of the play structures 100, 100' is constructed from eighteen (18) of the first tubes 12*a*, two (2) of the third tubes 12*c*, eleven (11) of the fourth tubes 14*a*, twenty-four (24) of the fifth tubes 14*b*, fourteen (14) of the sixth tubes 14*c*, eleven (11) of the seventh tubes 14*d*, seventeen (17) of the 6-way connectors 16*a*, nineteen (19) of the 3-way connectors 16*b*, six (6) of the 90-degree connectors 16*c*, four (4) of the 45-degree connectors 16*d*, and five (5) of the coupling connectors 16*e*.

A frame 102 of the play structures 100, 100', constructed from the tubes 12*a*, 12*c*, 14*a*, 14*b*, 14*c*, 14*d* and the connectors 16*a*, 16*b*, 16*c*, 16*d*, 16*e*, includes a main body 104, a plurality of wheels 106, and a steering device 108. As shown in FIG. 2, the main body 104 is formed by releasably assembling the tubes 12*c*, 14*a*, 14*b*, 14*c*, 14*d* together using the connectors 16*a*, 16*b*, 16*c*, 16*d*, 16*e* into a box-like structure. Each of the wheels 106 is formed by releasably assembling the first tubes 12*a* together with the fifth tubes 14*b* using the connectors 16*a*, 16*b*. The steering device 108 is formed by releasably assembling the first tubes 12*a* together with the fifth tubes 14*b* using the connectors 16*a*, 16*c*, 16*e*. Each of the wheels 106 and the steering device 108 is releasably attached to the main body 104 using one of the tubes 14*a*.

As shown in FIG. 3, the play structure 100' further includes the at least one covering 24 releasably affixed to the frame 104. In certain embodiments, the at least one covering 24 is releasably affixed to the frame 104 using the covering connectors 18 (shown in FIG. 1). In particular, an edge of the at least one covering 24 is aligned with one of the tubes 12*a*, 12*c*, 14*a*, 14*b*, 14*c*, 14*d* and secured with one of the covering connectors 18. The covered tubes 12*a*, 12*c*, 14*a*, 14*b*, 14*c*, 14*d* are rolled until the at least one covering 24 is pulled tight and the covering connectors 18 are not visible.

Figure 4:
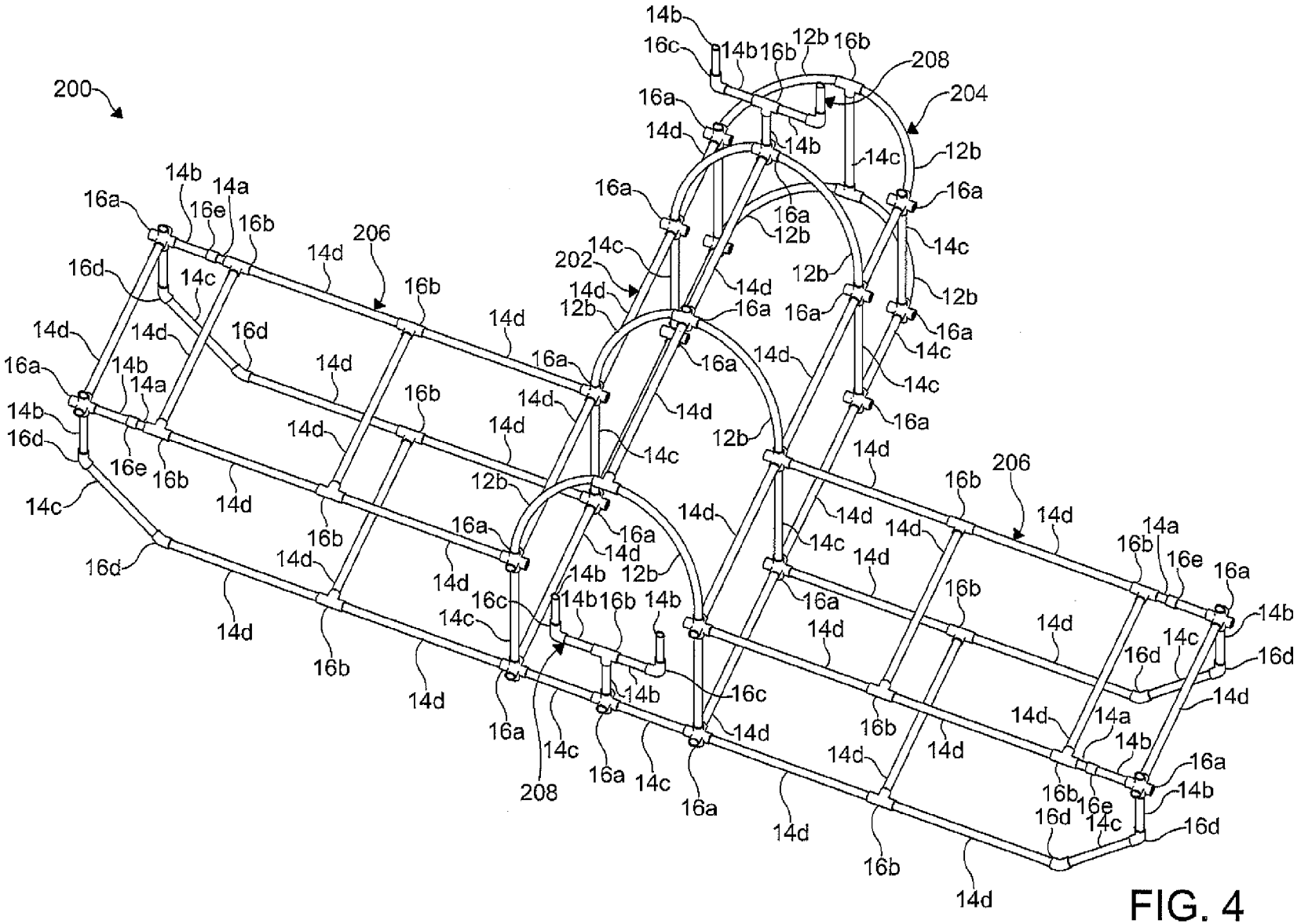
FIG. 4 is a perspective view of a play structure constructed from the kit illustrated in FIG. 1, wherein the play structure has an airplane-shaped configuration.
Figure 5:
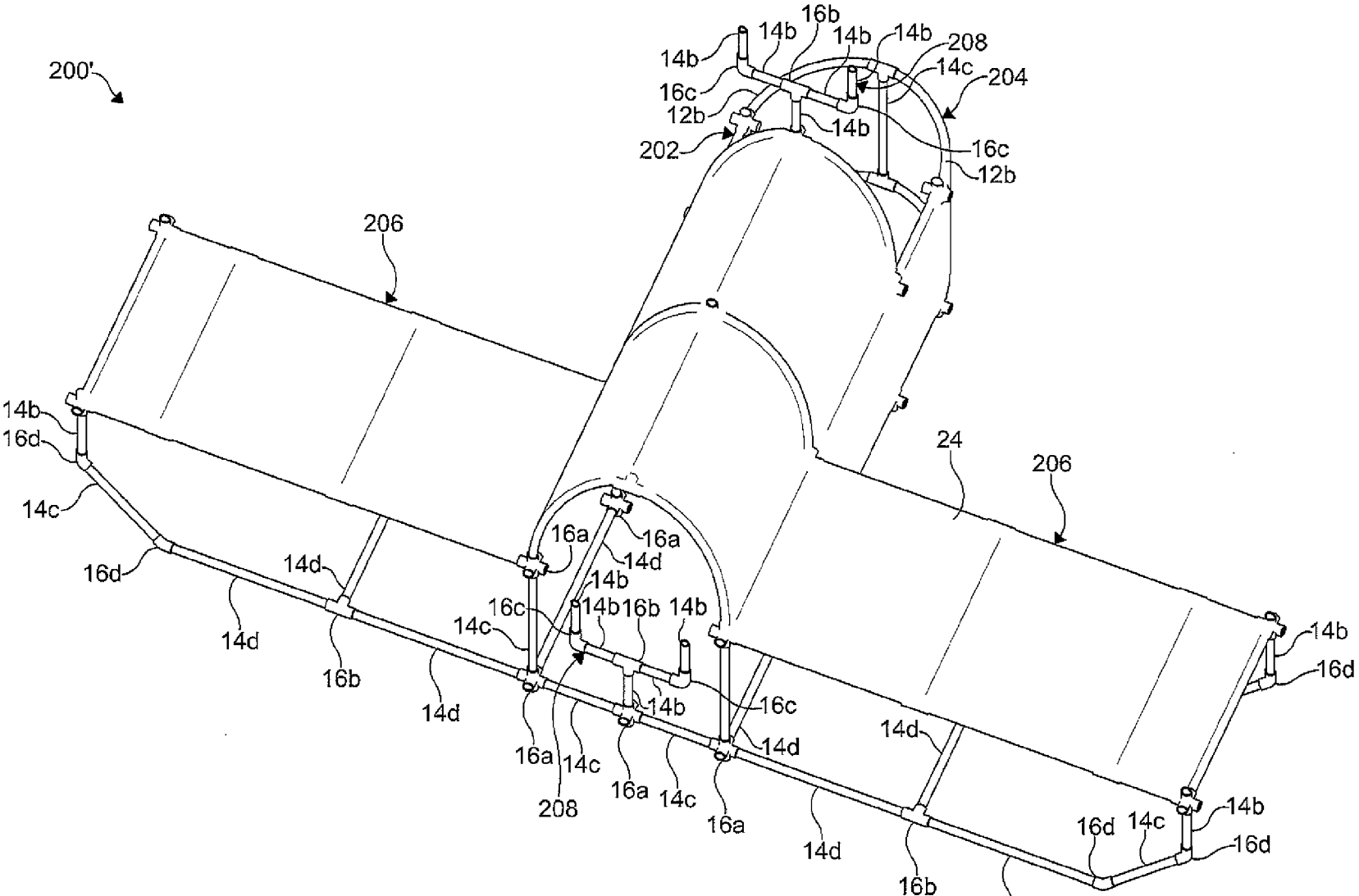
FIG. 5 is a perspective view of the play structure of FIG. 4 having a covering disposed on at least a portion thereof.

As shown in FIGS. 4-5, the kit 10 is used to construct the play structures 200, 200' having an airplane-shaped configuration. In certain embodiments, each of the play structures 200, 200' is constructed from ten (10) of the second tubes 12*b*, four (4) of the fourth tubes 14*a*, eighteen (18) of the fifth tubes 14*b*, seventeen (17) of the sixth tubes 14*c*, thirty-four (34) of the seventh tubes 14*d*, twenty-two (22) of the 6-way connectors 16*a*, eighteen (18) of the 3-way connectors 16*b*, four (4) of the 90-degree connectors 16*c*, eight (8) of the 45-degree connectors 16*d*, and four (4) of the coupling connectors 16*e*.

A frame 202 of the play structures 200, 200', constructed from the tubes 12*b*, 14*a*, 14*b*, 14*c*, 14*d* and the connectors 16*a*, 16*b*, 16*c*, 16*d*, 16*e*, includes a main body 204, a pair of laterally, opposed wings 206, and a pair of steering devices 208. As shown in FIG. 4, the main body 204 is formed by releasably assembling the tubes 12*b*, 14*c*, 14*d* together using the connectors 16*a*, 16*b*, into a box-like structure. Each of the wings 206 is formed by releasably assembling the tubes 14*a*, 14*b*, 14*c*, 14*d* together using the connectors 16*a*, 16*b*, 16*d*, 16*e*. The steering devices 208 are formed by releasably assembling the fifth tubes 14*b* together using the connectors 16*b*, 16*c*. Each of the wings 206 and the steering devices 208 is releasably attached to the main body 204 by inserting ends of the tubes 14*b*, 14*d* into the openings 30 of the 6-way connector 16*a*.

As shown in FIG. 5, the play structure 200' further includes the at least one covering 24 releasably affixed to the frame 204. In certain embodiments, the at least one covering 24 is releasably affixed to the frame 204 using the covering connectors 18 (shown in FIG. 1). In particular, an edge of the at least one covering 24 is aligned with one of the tubes 12*b*, 14*a*, 14*b*, 14*c*, 14*d* and secured with one of the covering connectors 18. The covered tubes 12*b*, 14*a*, 14*b*, 14*c*, 14*d* are rolled until the at least one covering 24 is pulled tight and the covering connectors 18 are not visible.

Figure 6:
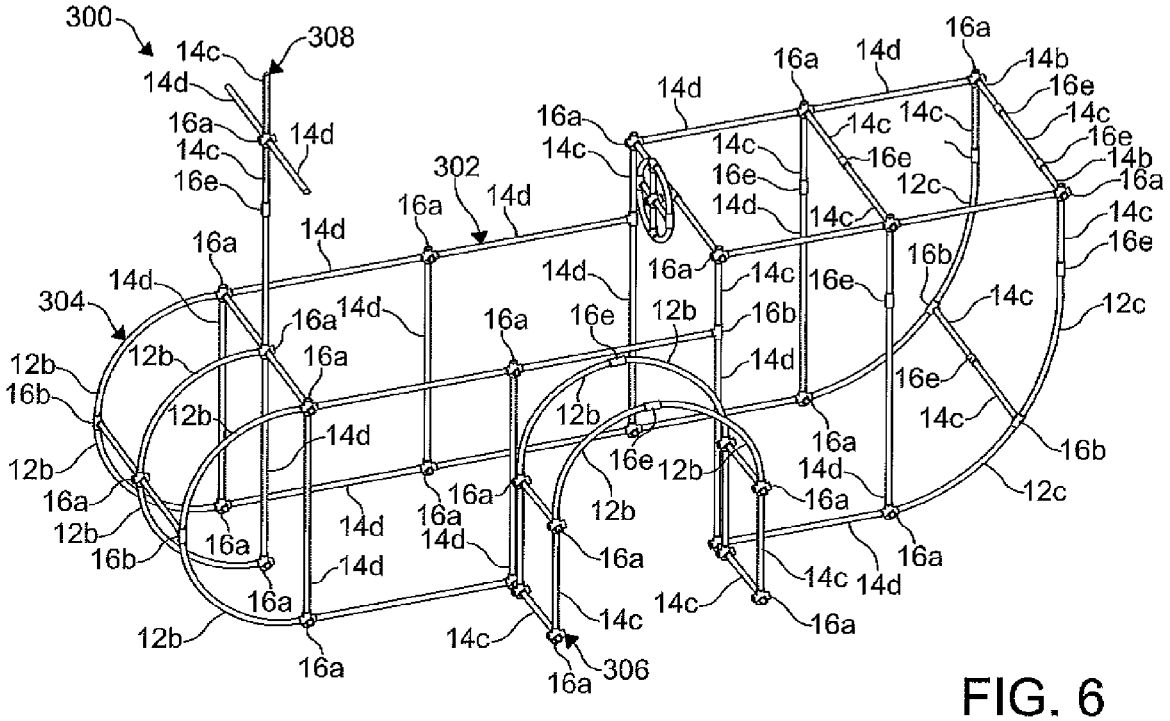
FIG. 6 is a perspective view of a play structure constructed from the kit illustrated in FIG. 1, wherein the play structure has a pirate ship-shaped configuration.
Figure 7:
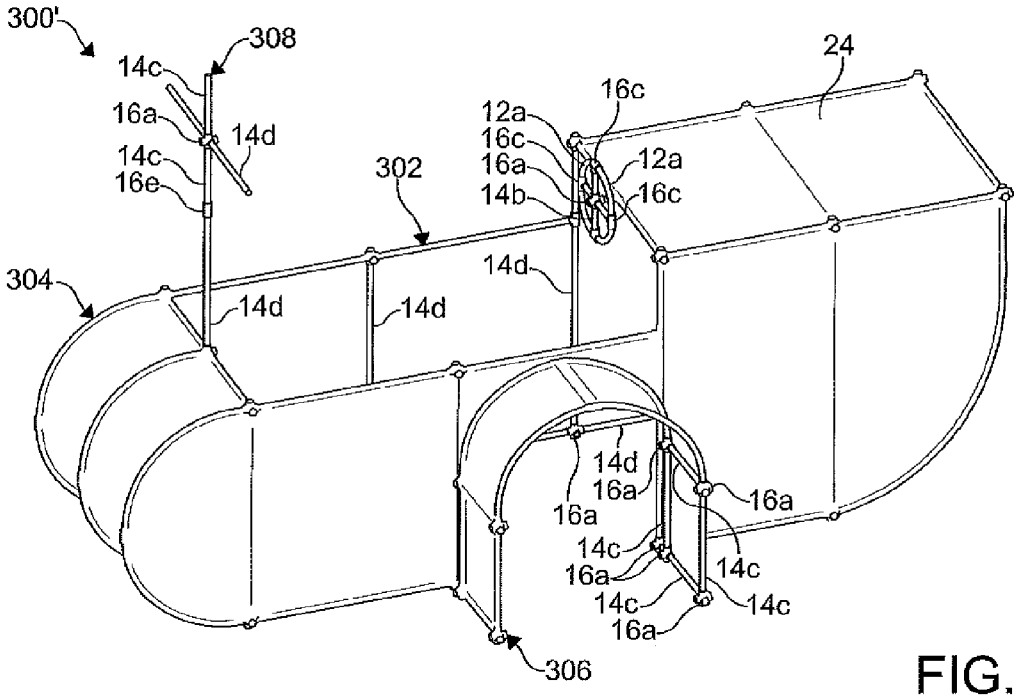
FIG. 7 is a perspective view of the play structure of FIG. 6 having a covering disposed on at least a portion thereof.

As shown in FIGS. 6-7, the kit 10 is used to construct the play structures 300, 300' having a pirate ship-shaped configuration. In certain embodiments, each of the play structures 300, 300' is constructed from four (4) of the first tubes 12*a*, ten (10) of the second tubes 12*b*, four (4) of the third tubes 12*c*, five (5) of the fourth tubes 14*a*, four (4) of the fifth tubes 14*b*, twenty-two (22) of the sixth tubes 14*c*, thirty-six (36) of the seventh tubes 14*d*, twenty-five (25) of the 6-way connectors 16*a*, nineteen (19) of the 3-way connectors 16*b*, and ten (10) of the coupling connectors 16*e*.

A frame 302 of the play structures 300, 300', constructed from the tubes 12*a*, 12*b*, 12*c*, 14*a*, 14*b*, 14*c*, 14*d* and the connectors 16*a*, 16*b*, 16*e*, includes a main body 304, an entrance opening 306, a mast 308, and a steering device 310.

As shown in FIG. 6, the main body 304 is formed by releasably assembling the tubes 12*b*, 12*c*, 14*c*, 14*d* together using the connectors 16*a*, 16*b*, 16*e* into a box-like structure. The entrance opening 306 is formed by releasably assembling the tubes 12*b*, 14*c*, together using the connectors 16*a*, 16*b*. The mast 308 is formed by releasably assembling the tubes 12*c*, 12*d* together using the connectors 16*a*, 16*e*. The steering device 310 is formed by releasably assembling the first tubes 12*a* together with the fifth tubes 14*b* using the connectors 16*a*, 16*b*. The entrance opening 306 and the steering device 310 are releasably attached to the main body 304 by the fourth tubes 14*a*. The mast 308 is releasably attached to the main body 304 by inserting an end of the tube 14*d* into the opening 30 of the 6-way connector 16*a*.

As shown in FIG. 7, the play structure 300' further includes the at least one covering 24 releasably affixed to the frame 302. In certain embodiments, the at least one covering 24 is releasably affixed to the frame 302 using the covering connectors 18 (shown in FIG. 1). In particular, an edge of the at least one covering 24 is aligned with one of the tubes 12*b*, 12*c*, 14*a*, 14*b*, 14*c*, 14*d* and secured with one of the covering connectors 18. The covered tubes 12*b*, 12*c*, 14*a*, 14*b*, 14*c*, 14*d* are rolled until the at least one covering 24 is pulled tight and the covering connectors 18 are not visible.

Figure 8:
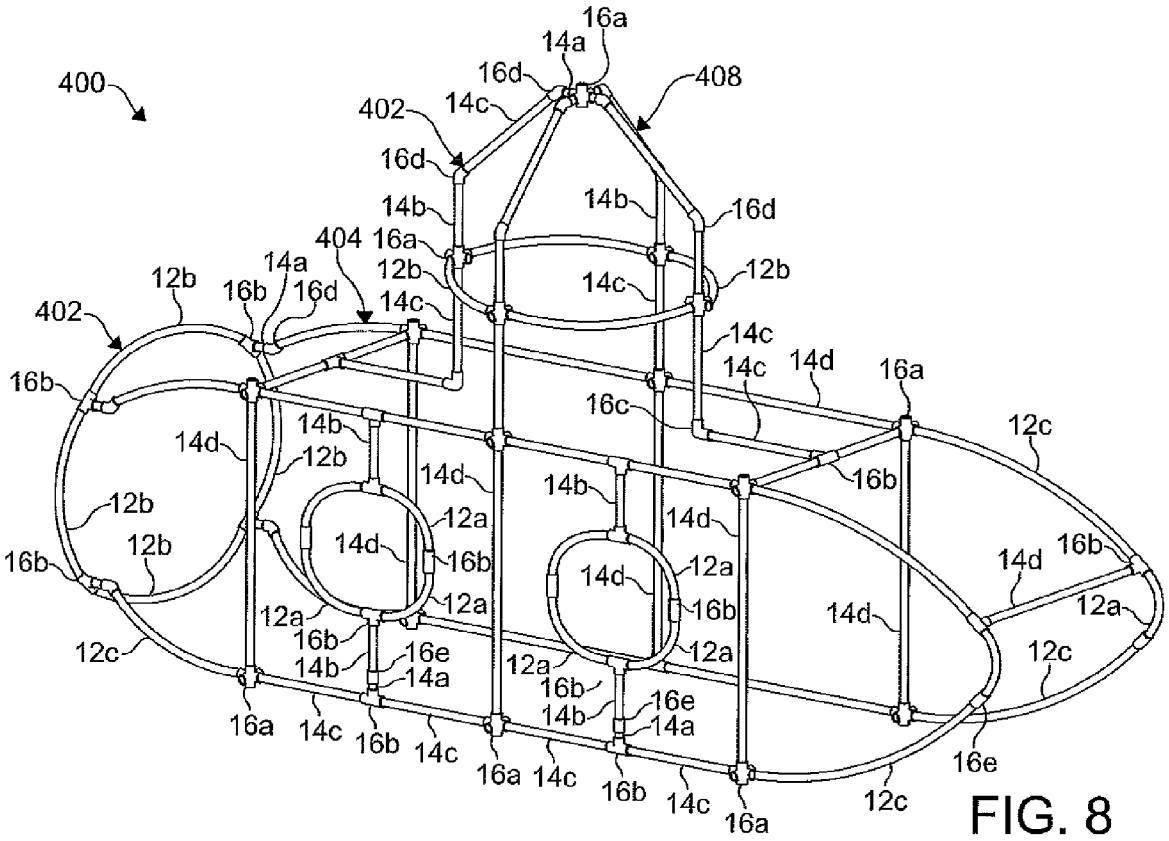
FIG. 8 is a perspective view of a play structure constructed from the kit illustrated in FIG. 1, wherein the play structure has a submarine-shaped configuration.
Figure 9:
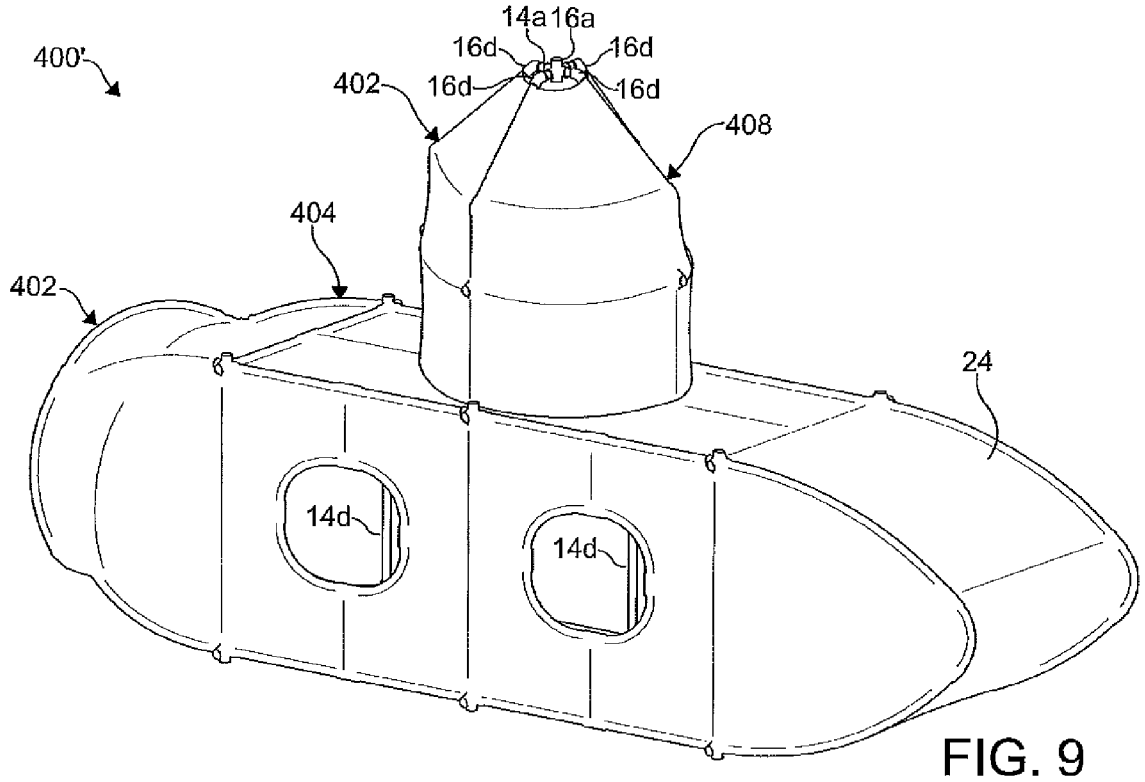
FIG. 9 is a perspective view of the play structure of FIG. 8 having a covering disposed on at least a portion thereof.

As shown in FIGS. 8-9, the kit 10 is used to construct the play structures 400, 400' having a submarine-shaped configuration. In certain embodiments, each of the play structures 400, 400' is constructed from ten (10) of the first tubes 12*a*, eight (8) of the second tubes 12*b*, eight (8) of the third tubes 12*c*, ten (10) of the fourth tubes 14*a*, eight (8) of the fifth tubes 14*b*, twenty-two (22) of the sixth tubes 14*c*, eleven (11) of the seventh tubes 14*d*, seventeen (17) of the 6-way connectors 16*a*, sixteen (16) of the 3-way connectors 16*b*, two (2) of the 90 degree connectors 16*c*, twelve (12) of the 45-degree connectors 16*d*, and eight (8) of the coupling connectors 16*e*.

A frame 402 of the play structures 400, 400', constructed from the tubes 12*a*, 12*b*, 12*c*, 14*a*, 14*b*, 14*c*, 14*d* and the connectors 16*a*, 16*b*, 16*c*, 16*d*, 16*e*, includes a main body 404, an entrance opening 406, and a hatch 408. As shown in FIG. 8, the main body 404 is formed by releasably assembling the tubes 12*a*, 12*c*, 14*a*, 14*b*, 14*c*, 14*d* together using the connectors 16*a*, 16*b*, 16*c*, 16*d*, 16*e* into a box-like structure. The entrance opening 406 is formed by releasably assembling the tubes 12*b* together using the connectors 16*b*. The hatch 408 is formed by releasably assembling the tubes 12*b*, 14*a*, 14*b*, 14*c* together using the connectors 16*a*, 16*d*, 16*e*. The entrance opening 406 is releasably attached to the main body 404 by the fourth tubes 14*a*. The hatch 408 can be pivotally attached to the main body 404 if desired.

As shown in FIG. 9, the play structure 400' further includes the at least one covering 24 releasably affixed to the frame 402. In certain embodiments, the at least one covering 24 is releasably affixed to the frame 402 using the covering connectors 18 (shown in FIG. 1). In particular, an edge of the at least one covering 24 is aligned with one of the tubes 12*a*, 12*b*, 12*c*, 14*a*, 14*b*, 14*c*, 14*d* and secured with one of the covering connectors 18. The covered tubes 12*a*, 12*b*, 12*c*, 14*a*, 14*b*, 14*c*, 14*d* are rolled until the at least one covering 24 is pulled tight and the covering connectors 18 are not visible.

As shown in FIGS. 10-11, the kit 10 is used to construct the play structures 500, 500' having a canoe-shaped configuration. In certain embodiments, each of the play structures 500, 500' is constructed from six (6) of the first tubes 12*a*, eight (8) of the third tubes 12*c*, ten (10) of the fourth tubes 14*a*, thirteen (13) of the fifth tubes 14*b*, six (6) of the sixth tubes 14*c*, thirteen (13) of the seventh tubes 14*d*, twelve (12) of the 6-way connectors 16*a*, ten (10) of the 3-way connectors 16*b*, four (4) of the 90-degree connectors 16*c*, twelve (12) of the 45-degree connectors 16*d*, and four (4) of the coupling connectors 16*e*.

A frame 502 of the play structures 500, 500', constructed from the tubes 12*a*, 12*c*, 14*a*, 14*b*, 14*c*, 14*d* and the connectors 16*a*, 16*b*, 16*c*, 16*d*, 16*e*, includes a main body 504 and an accessory 506. As shown in FIG. 10, the main body 504 is formed by releasably assembling the tubes 12*a*, 12*c*, 14*a*, 14*b*, 14*c*, 14*d* together using the connectors 16*a*, 16*b*, 16*c*, 16*d*, 16*e* into a box-like structure. The accessory 506 is formed by releasably assembling the tubes 12*a*, 14*a*, 14*b*, 14*d* together using the connectors 16*b*, 16*d*.

As shown in FIG. 11, the play structure 500' further includes the at least one covering 24 releasably affixed to the frame 502. In certain embodiments, the at least one covering 24 is releasably affixed to the frame 502 using the covering connectors 18 (shown in FIG. 1). In particular, an edge of the at least one covering 24 is aligned with one of the tubes 12*a*, 12*c*, 14*a*, 14*b*, 14*c*, 14*d* and secured with one of the covering connectors 18. The covered tubes 12*a*, 12*c*, 14*a*, 14*b*, 14*c*, 14*d* are rolled until the at least one covering 24 is pulled tight and the covering connectors 18 are not visible.

Figure 13:
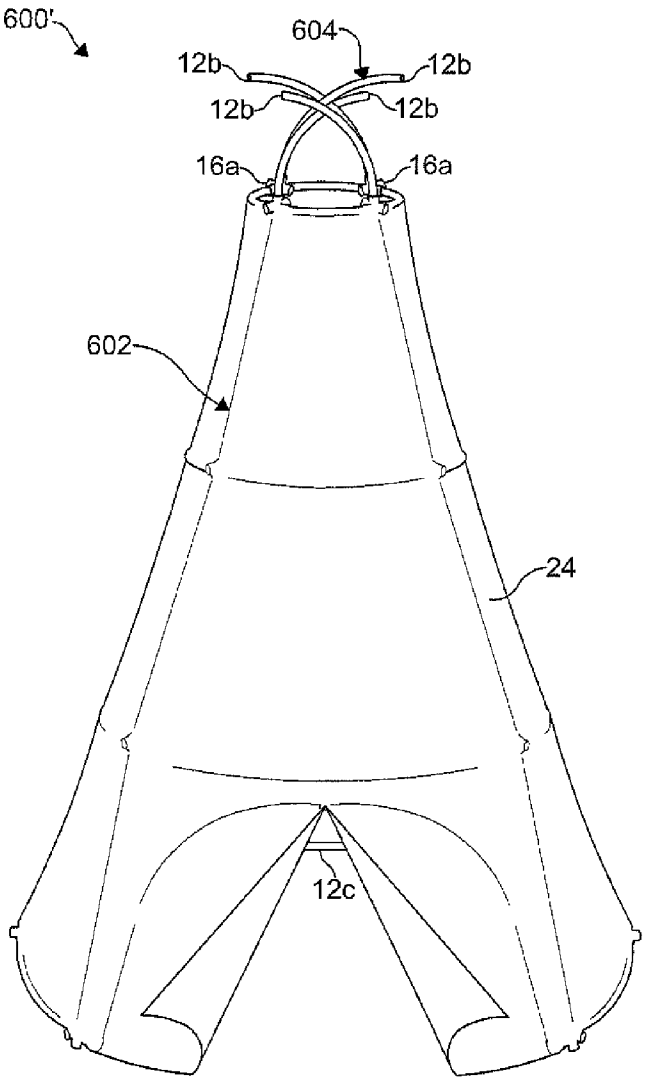
FIG. 13 is a perspective view of the play structure of FIG. 12 having a covering disposed on at least a portion thereof.
Figure 12:
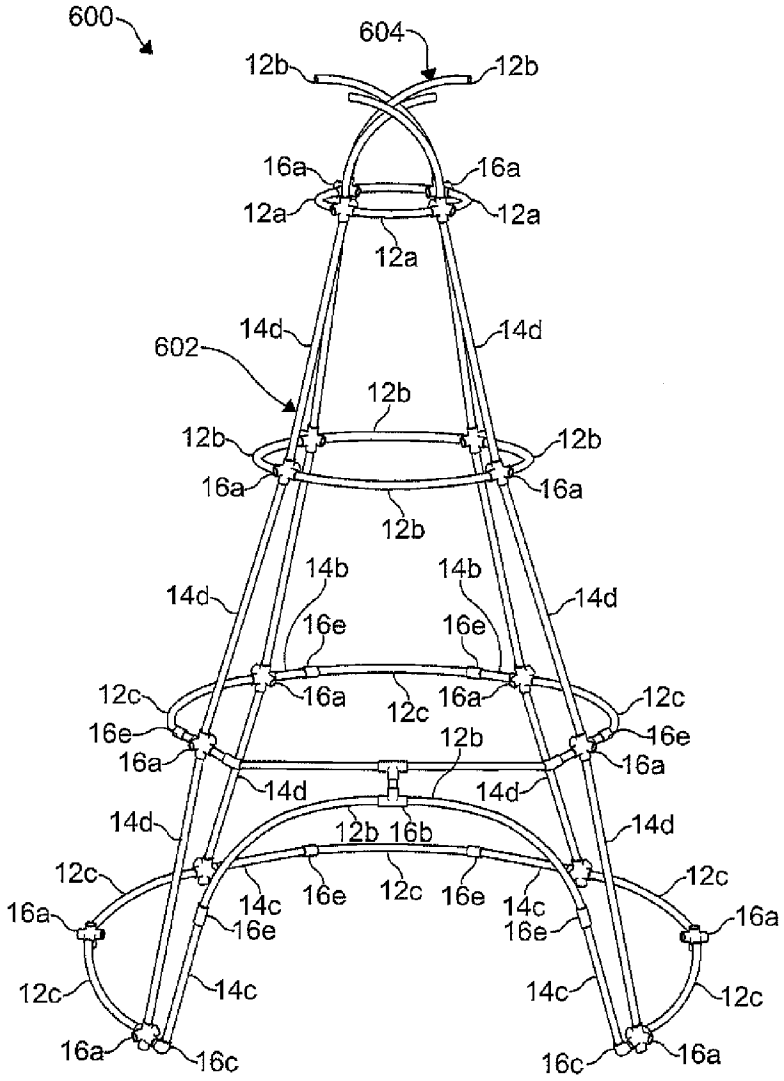
FIG. 12 is a perspective view of a play structure constructed from the kit illustrated in FIG. 1, wherein the play structure has a teepee-shaped configuration.

As shown in FIGS. 12-13, the kit 10 is used to construct the play structures 600, 600' having a teepee-shaped configuration. In certain embodiments, each of the play structures 600, 600' is constructed from four (4) of the first tubes 12*a*, ten (10) of the second tubes 12*b*, eight (8) of the third tubes 12*c*, three (3) of the fourth tubes 14*a*, eight (8) of the fifth tubes 14*b*, six (6) of the sixth tubes 14*c*, twelve (12) of the seventh tubes 14*d*, eighteen (18) of the 6-way connectors 16*a*, two (2) of the 3-way connectors 16*b*, two (2) of the 90-degree connectors 16*c*, two (2) of the 45-degree connectors 16*d*, and ten (10) of the coupling connectors 16*e*.

A frame 602 of the play structures 600, 600', constructed from the tubes 12*a*, 12*b*, 12*c*, 14*a*, 14*b*, 14*c*, 14*d* and the connectors 16*a*, 16*b*, 16*c*, 16*d*, 16*e*, includes a main body 604. As shown in FIG. 12, the main body 604 is formed by releasably assembling the tubes 12*a*, 12*b*, 12*c*, 14*a*, 14*b*, 14*c*, 14*d* together using the connectors 16*a*, 16*b*, 16*c*, 16*d*, 16*e* into a teepee-like structure.

As shown in FIG. 13, the play structure 600' further includes the at least one covering 24 releasably affixed to the frame 602. In certain embodiments, the at least one covering 24 is releasably affixed to the frame 602 using the covering connectors 18 (shown in FIG. 1). In particular, an edge of the at least one covering 24 is aligned with one of the tubes 12*a*, 12*b*, 12*c*, 14*a*, 14*b*, 14*c*, 14*d* and secured with one of the covering connectors 18. The covered tubes 12*a*, 12*b*, 12*c*, 14*a*, 14*b*, 14*c*, 14*d* are rolled until the at least one covering 24 is pulled tight and the covering connectors 18 are not visible.

Figure 14:
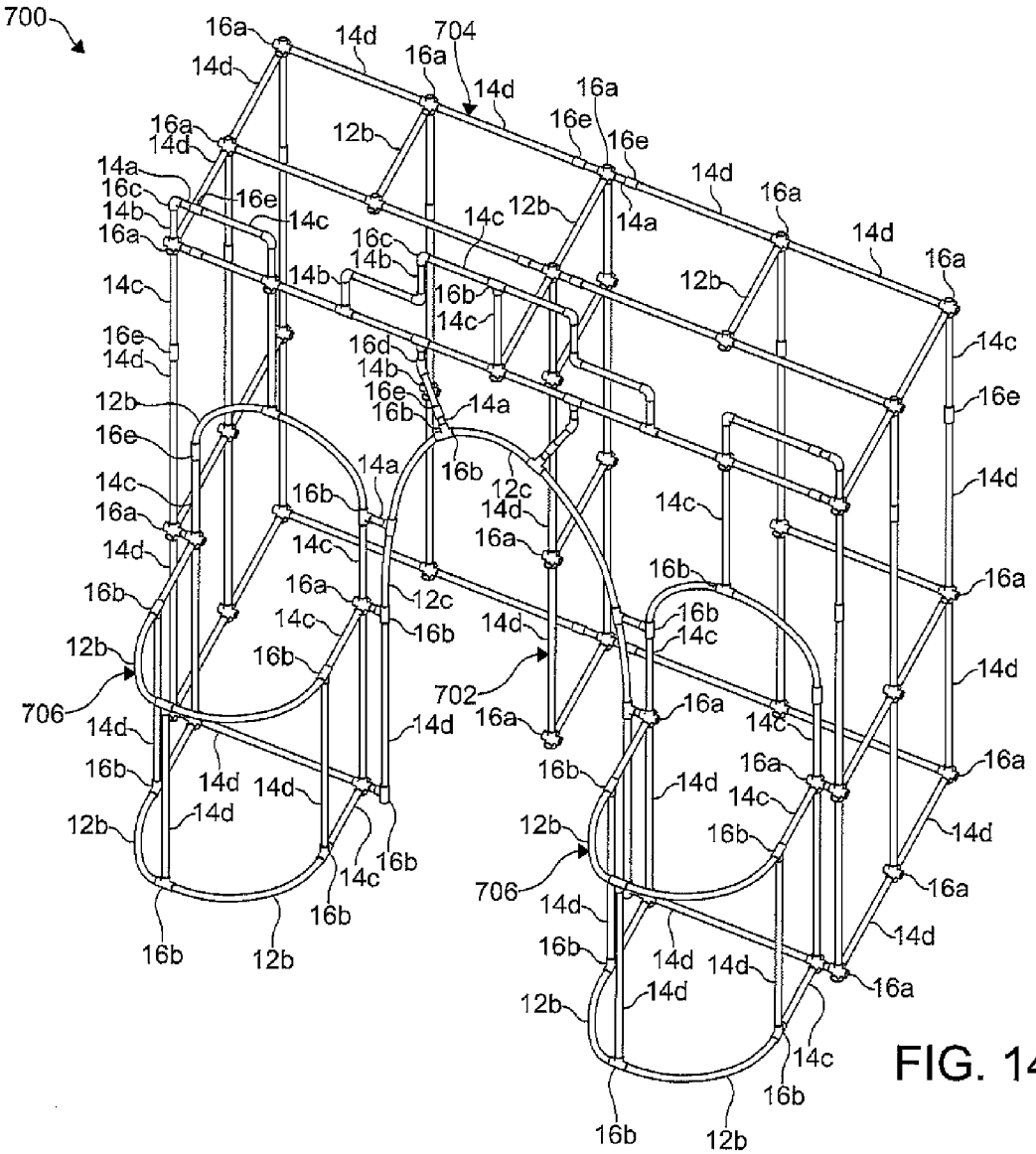
FIG. 14 is a perspective view of a play structure constructed from the kit illustrated in FIG. 1, wherein the play structure has a castle-shaped configuration.
Figure 15:
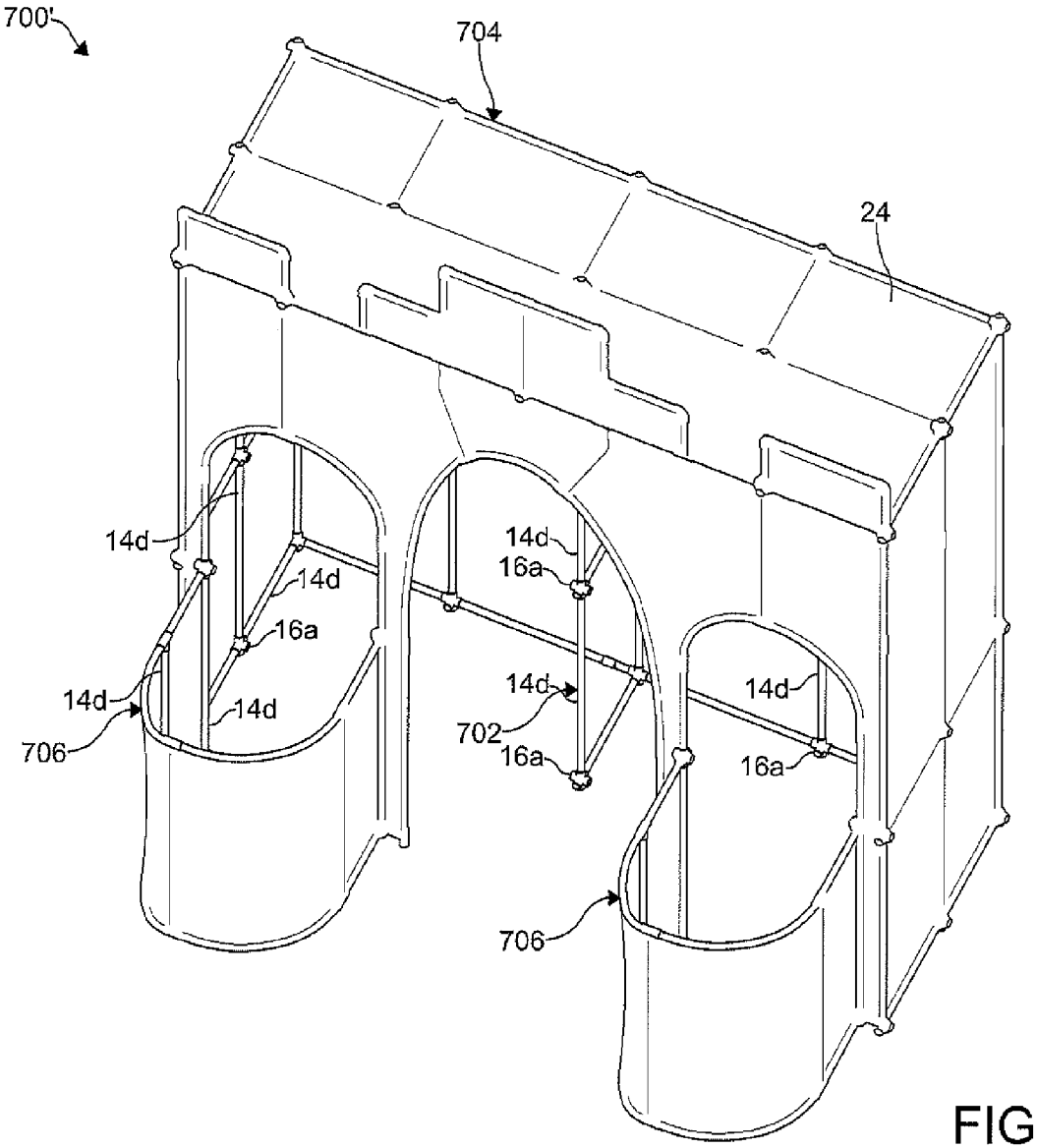
FIG. 15 is a perspective view of the play structure of FIG. 14 having a covering disposed on at least a portion thereof.

As shown in FIGS. 14-15, numerous kits 10 can be used to construct the play structures 700, 700' having a castle-shaped configuration. In certain embodiments, each of the play structures 700, 700' is constructed from twelve (12) of the second tubes 12*b*, three (3) of the third tubes 12*c*, twenty-two (22) of the fourth tubes 14*a*, ten (10) of the fifth tubes 14*b*, forty-one (41) of the sixth tubes 14*c*, sixty-nine (69) of the seventh tubes 14*d*, forty-two (42) of the 6-way connectors 16*a*, thirty-two (32) of the 3-way connectors 16*b*, ten (10) of the 90-degree connectors 16*c*, two (2) of the 45-degree connectors 16*d*, and twenty (20) of the coupling connectors 16*e*.

A frame 702 of the play structures 700, 700', constructed from the tubes 12*b*, 12*c*, 14*a*, 14*b*, 14*c*, 14*d* and the connectors 16*a*, 16*b*, 16*c*, 16*d*, 16*e*, includes a main body 704 and a pair of laterally, extending play areas 706. As shown in FIG. 14, the main body 704 is formed by releasably assembling the tubes 12*b*, 12*c*, 14*a*, 14*b*, 14*c*, 14*d* together using the connectors 16*a*, 16*b*, 16*c*, 16*d*, 16*e* into a box-like structure. The play areas 706 are formed by releasably assembling the tubes 12*b*, 14*c*, 14*d* together using the connectors 16*b*. Each of the play areas 706 is releasably attached to the main body 704 by inserting an end of the sixth tubes 14*c* into the opening 30 of the 6-way connector 16*a*.

As shown in FIG. 15, the play structure 700' further includes the at least one covering 24 releasably affixed to the frame 702. In certain embodiments, the at least one covering 24 is releasably affixed to the frame 702 using the covering connectors 18 (shown in FIG. 1). In particular, an edge of the at least one covering 24 is aligned with one of the tubes 12*b*, 12*c*, 14*a*, 14*b*, 14*c*, 14*d* and secured with one of the covering connectors 18. The covered tubes 12*b*, 12*c*, 14*a*, 14*b*, 14*c*, 14*d* are rolled until the at least one covering 24 is pulled tight and the covering connectors 18 are not visible.

Figure 16:
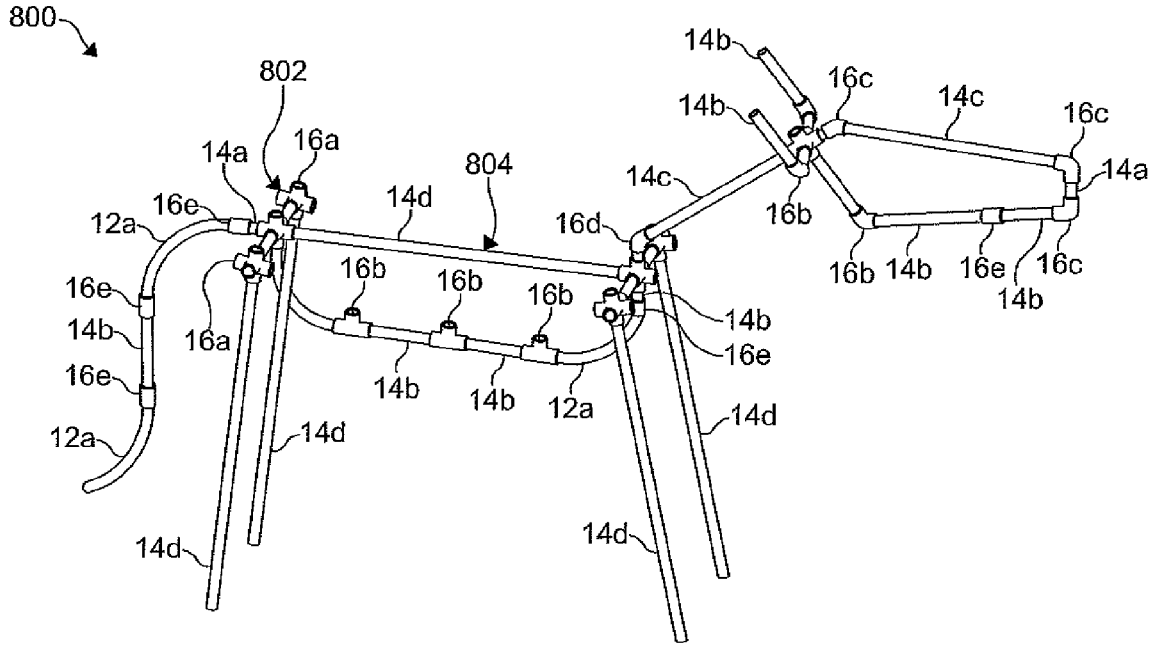
FIG. 16 is a perspective view of a play structure constructed from the kit illustrated in FIG. 1, wherein the play structure has a horse-shaped configuration.
Figure 17:
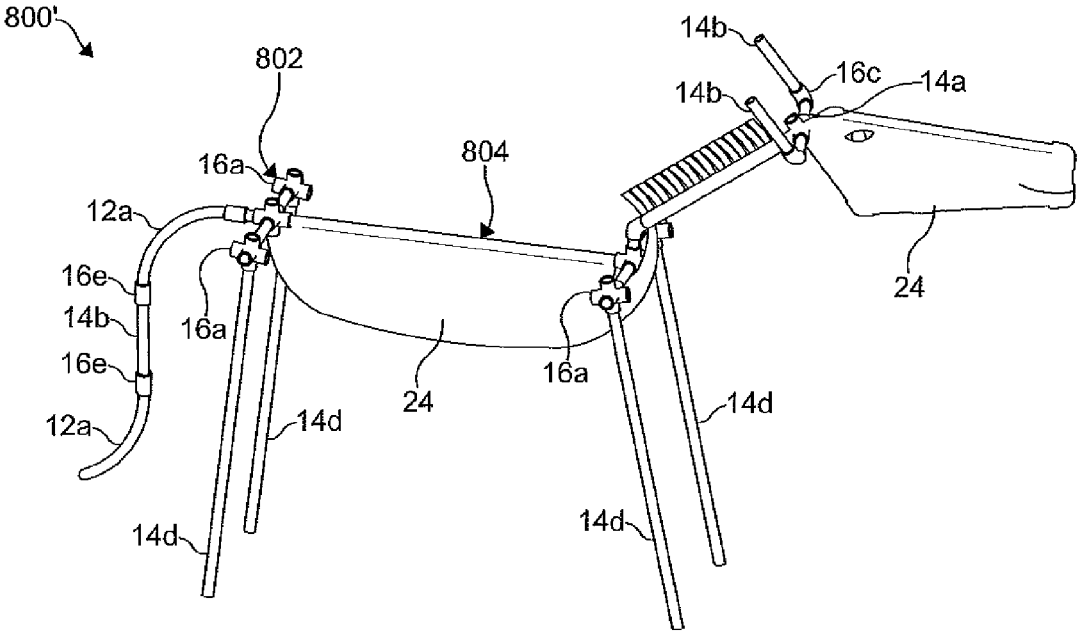
FIG. 17 is a perspective view of the play structure of FIG. 16 having a covering disposed on at least a portion thereof.

As shown in FIGS. 16-17, the kit 10 is used to construct the play structures 800, 800' having a horse-shaped configuration. In certain embodiments, each of the play structures 800, 800' is constructed from four (4) of the first tubes 12*a*, seven (7) of the fourth tubes 14*a*, twelve (12) of the fifth tubes 14*b*, two (2) of the sixth tubes 14*c*, five (5) of the seventh tubes 14*d*, seven (7) of the 6-way connectors 16*a*, four (4) of the 3-way connectors 16*b*, three (3) of the 90-degree connectors 16*c*, four (4) of the 45-degree connectors 16*d*, and four (4) of the coupling connectors 16*e*.

A frame 802 of the play structures 800, 800', constructed from the tubes 12*a*, 14*a*, 14*b*, 14*c*, 14*d* and the connectors 16*a*, 16*b*, 16*c*, 16*d*, 16*e*, includes a main body 804. As shown in FIG. 16, the main body 804 is formed by releasably assembling the tubes 12*a*, 14*a*, 14*b*, 14*c*, 14*d* together using the connectors 16*a*, 16*b*, 16*c*, 16*d*, 16*e* into a horse-like structure.

As shown in FIG. 17, the play structure 800' further includes the at least one covering 24 releasably affixed to the frame 802. In certain embodiments, the at least one covering 24 is releasably affixed to the frame 802 using the covering connectors 18 (shown in FIG. 1). In particular, an edge of the at least one covering 24 is aligned with one of the tubes 12*a*, 14*a*, 14*b*, 14*c*, 14*d* and secured with one of the covering connectors 18. The covered tubes 12*a*, 14*a*, 14*b*, 14*c*, 14*d* are rolled until the at least one covering 24 is pulled tight and the covering connectors 18 are not visible.

Figure 18:
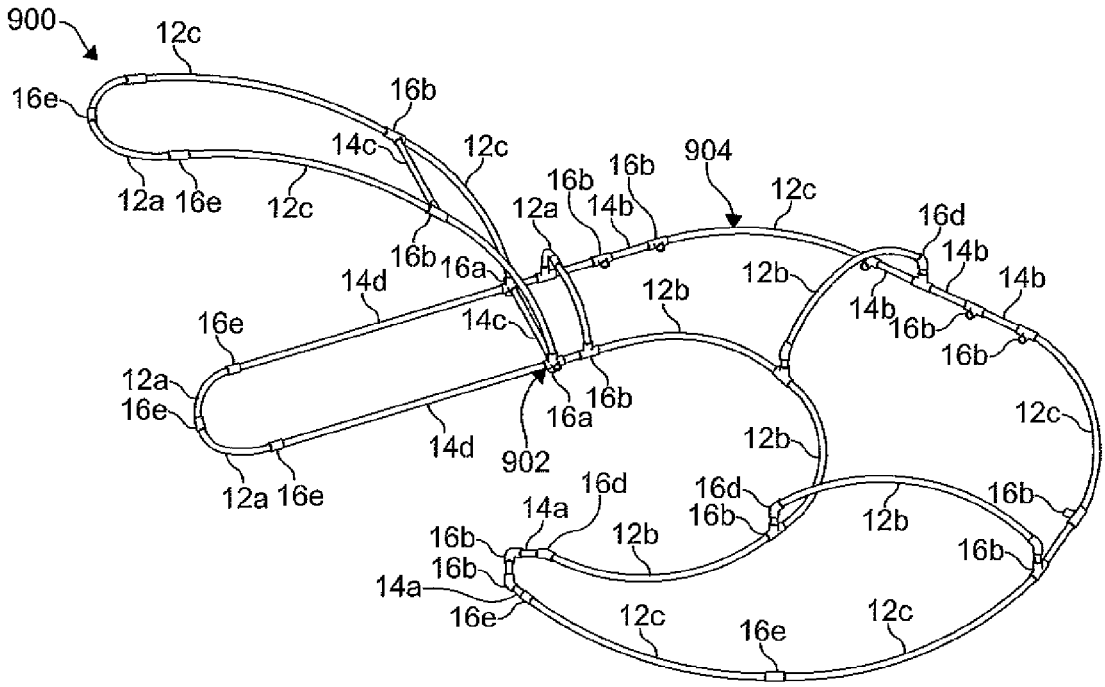
FIG. 18 is a perspective view of a play structure constructed from the kit illustrated in FIG. 1, wherein the play structure has a reptile-shaped configuration.
Figure 19:
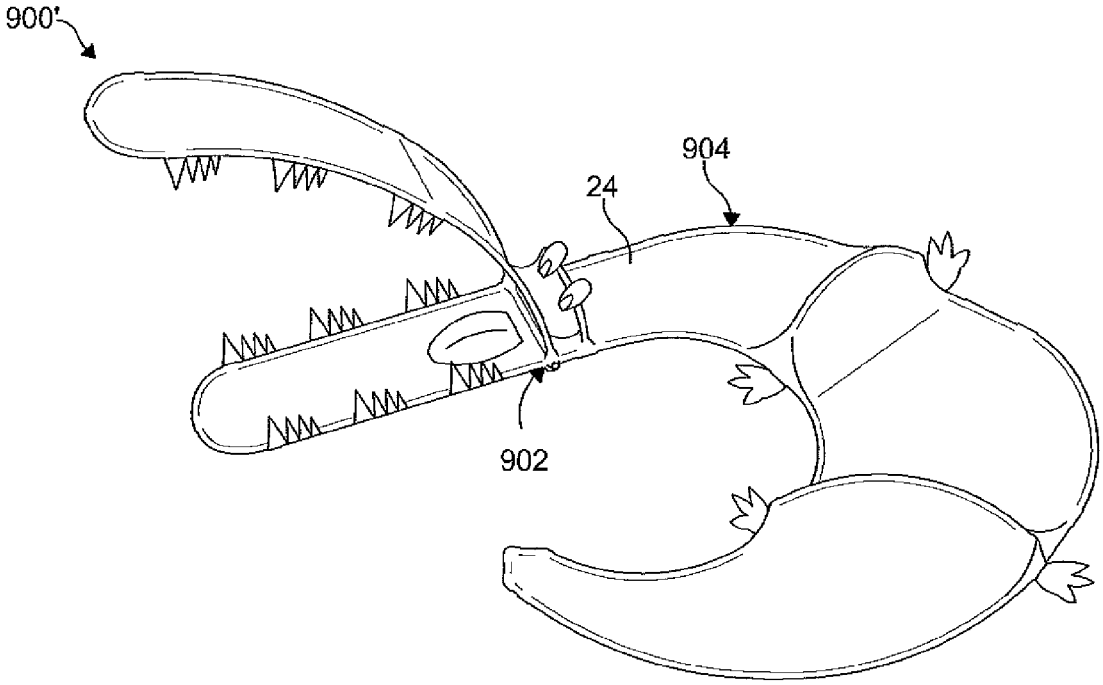
FIG. 19 is a perspective view of the play structure of FIG. 18 having a covering disposed on at least a portion thereof.

As shown in FIGS. 18-19, the kit 10 is used to construct the play structures 900, 900' having a reptile-shaped configuration. In certain embodiments, each of the play structures 900, 900' is constructed from six (6) of the first tubes 12*a*, five (5) of the second tubes 12*b*, eight (8) of the third tubes 12*c*, nine (9) of the fourth tubes 14*a*, six (6) of the fifth tubes 14*b*, two (2) of the sixth tubes 14*c*, two (2) of the seventh tubes 14*d*, two (2) of the 6-way connectors 16*a*, fourteen (14) of the 3-way connectors 16*b*, one (1) of the 90-degree connectors 16*c*, six (6) of the 45-degree connectors 16*d*, and seven (7) of the coupling connectors 16*e*.

A frame 902 of the play structures 900, 900', constructed from the tubes 12*a*, 12*b*, 12*c*, 14*a*, 14*b*, 14*c*, 14*d* and the connectors 16*a*, 16*b*, 16*c*, 16*d*, 16*e*, includes a main body 904. As shown in FIG. 18, the main body 904 is formed by releasably assembling the tubes 12*a*, 12*b*, 12*c*, 14*a*, 14*b*, 14*c*, 14*d* together using the connectors 16*a*, 16*b*, 16*c*, 16*d*, 16*e* into a reptile-like structure.

As shown in FIG. 19, the play structure 900' further includes the at least one covering 24 releasably affixed to the frame 902. In certain embodiments, the at least one covering 24 is releasably affixed to the frame 902 using the covering connectors 18 (shown in FIG. 1). In particular, an edge of the at least one covering 24 is aligned with one of the tubes 12*a*, 12*b*, 12*c*, 14*a*, 14*b*, 14*c*, 14*d* and secured with one of the covering connectors 18. The covered tubes 12*a*, 12*b*, 12*c*, 14*a*, 14*b*, 14*c*, 14*d* are rolled until the at least one covering 24 is pulled tight and the covering connectors 18 are not visible.

Figure 20:
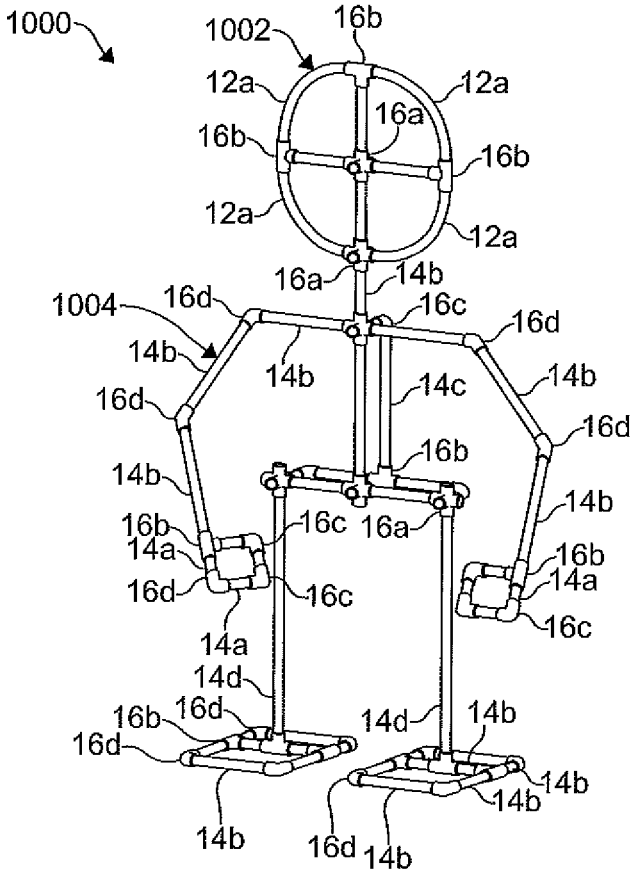
FIG. 20 is a perspective view of a play structure constructed from the kit illustrated in FIG. 1, wherein the play structure has a human-shaped configuration.

As shown in FIG. 20, the kit 10 is used to construct the play structure 1000 having a human-shaped configuration. In certain embodiments, the play structure 1000 is constructed from four (4) of the first tubes 12*a*, nineteen (19) of the fourth tubes 14*a*, twenty-two (22) of the fifth tubes 14*b*, two (2) of the sixth tubes 14*c*, two (2) of the seventh tubes 14*d*, six (6) of the 6-way connectors 16*a*, twelve (12) of the 3-way connectors 16*b*, seventeen (17) of the 90-degree connectors 16*c*, and four (4) of the 45-degree connectors 16*d*.

A frame 1002 of the play structure 1000, constructed from the tubes 12*a*, 14*a*, 14*b*, 14*c*, 14*d* and the connectors 16*a*, 16*b*, 16*c*, 16*d*, includes a main body 1004. As shown, the main body 1004 is formed by releasably assembling the tubes 12*a*, 14*a*, 14*b*, 14*c*, 14*d* together using the connectors 16*a*, 16*b*, 16*c*, 16*d*, into a human-like structure. It is understood that the play structure 1000 may include the at least one covering 24 releasably affixed to the frame 1002 if desired.

Figure 21:
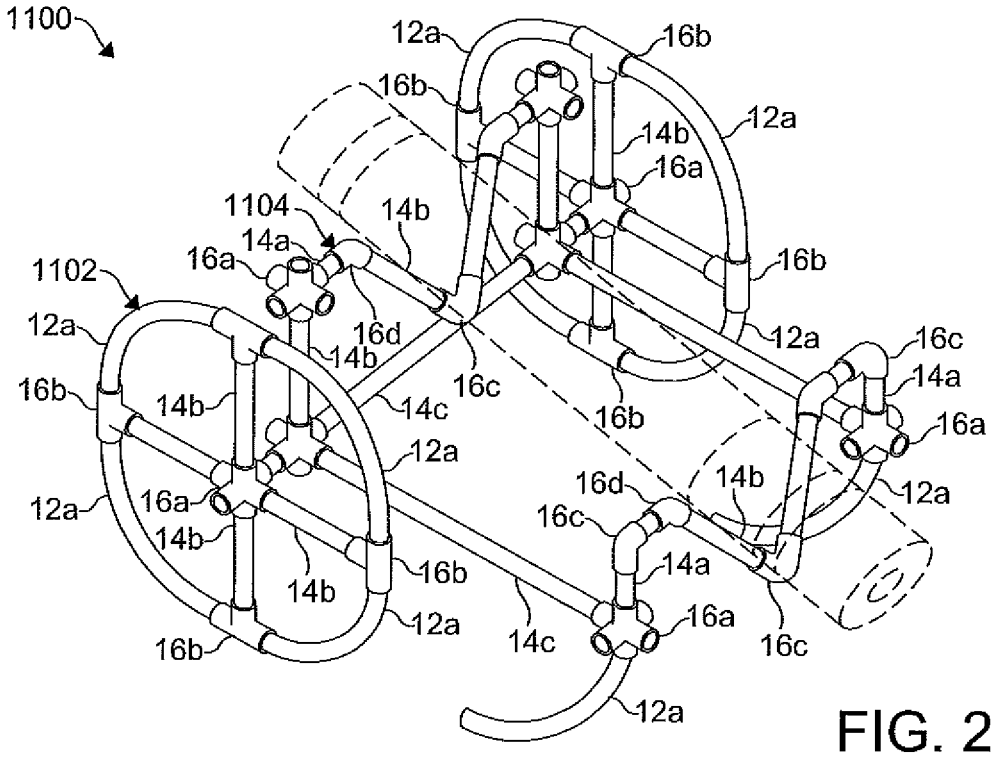
FIG. 21 is a perspective view of a play structure constructed from the kit illustrated in FIG. 1, wherein the play structure has a cannon-shaped configuration.

As shown in FIG. 21, the kit 10 is used to construct the play structures 1100 having a cannon-shaped configuration. In certain embodiments, the play structure 1100 is constructed from ten (10) of the first tubes 12*a*, eight (8) of the fourth tubes 14*a*, fourteen (14) of the fifth tubes 14*b*, three (3) of the sixth tubes 14*c*, eight (8) of the 6-way connectors 16*a*, eight (8) of the 3-way connectors 16*b*, four (4) of the 90-degree connectors 16*c*, and four (4) of the 45-degree connectors 16*d*.

A frame 1102 of the play structure 1100, constructed from the tubes 12*a*, 14*a*, 14*b*, 14*c*, 14*d* and the connectors 16*a*, 16*b*, 16*c*, 16*d*, includes a main body 1004. As shown, the main body 1104 is formed by releasably assembling the tubes 12*a*, 14*a*, 14*b*, 14*c*, 14*d* together using the connectors 16*a*, 16*b*, 16*c*, 16*d*, into a cannon-like structure. It is understood that the play structure 1100 may include the at least one covering 24 or other accessory such as a muzzle-like structure as indicated by dashed lines, for example, releasably affixed to the frame 1102 if desired.

Referring now to FIGS. 22-62, an accessory kit for use with the kit 10 is disclosed. The accessory kit may include a plurality of panels 42*a*, 42*b*, 42*c*, 42*d*, 42*e*, 42*f* and a plurality of 2-way couplers 44*a*, 44*b*, 44*c*, 44*d*, 44*e*, 44*f*, 44*g*, 44*h*, 44*i*, 44*j*, 44*k*, 44*l*, 44*m*, 44*n*, 44*o*, 44*p*, 44*q* including a first coupling means disposed at one end thereof and a second coupling means disposed at a second end thereof. Each of the 2-way couplers 44*a*, 44*b*, 44*c*, 44*d*, 44*e*, 44*f*, 44*g*, 44*h*, 44*i*, 44*j*, 44*k*, 44*l*, 44*m*, 44*n*, 44*o*, 44*p*, 44*q* included in the accessory kit is configured to be releasably coupled to at least one of the arcuate first tubes 12*a*, the arcuate second tubes 12*b*, the arcuate third tubes 12*c*, the linear fourth tubes 14*a*, the linear fifth tubes 14*b*, the linear sixth tubes 14*c*, the linear seventh tubes 14*d*, the 6-way tube connectors 16*a*, the 3-way tube connectors 16*b*, the 90-degree tube connectors 16*c*, the 45-degree tube connectors 16*d*, the coupling tube connectors 16*e*, the covering connectors 18, the panels 42*a*, 42*b*, 42*c*, 42*d*, 42*e*, 42*f* and any other 2-way couplers 44*a*, 44*b*, 44*c*, 44*d*, 44*e*, 44*f*, 44*g*, 44*h*, 44*i*, 44*j*, 44*k*, 44*l*, 44*m*, 44*n*, 44*o*, 44*p*, 44*q* included in the accessory kit. The panels 42*a*, 42*b*, 42*c*, 42*d*, 42*e*, 42*f* may be suitable for replacing the coverings 24 shown in the play structures 100', 200', 300', 400', 500', 600', 700', 800', 900', as the variety of panels 42*a*, 42*b*, 42*c*, 42*d*, 42*e*, 42*f* may be releasably coupled to a frame of each play structure 100', 200', 300', 400', 500', 600', 700', 800', 900' to enclose desired portions of the play structures 100', 200', 300', 400', 500', 600', 700', 800', 900'. Alternatively, the panels 42*a*, 42*b*, 42*c*, 42*d*, 42*e*, 42*f* may be used in addition to the coverings 24 to add alternative forms of decorative features to the play structures 100', 200', 300', 400', 500', 600', 700', 800', 900'.

FIGS. 22-27 illustrate several exemplary 2-way couplers 44*a*, 44*b*, 44*c*, 44*d*, 44*e*, 44*f* wherein at least one of the first coupling means and the second coupling means is one of a ball joint 50 and a ball joint clip 80, wherein the ball joint 50 is configured to be received in and releasably coupled to the ball joint clip 80.

Figure 22:
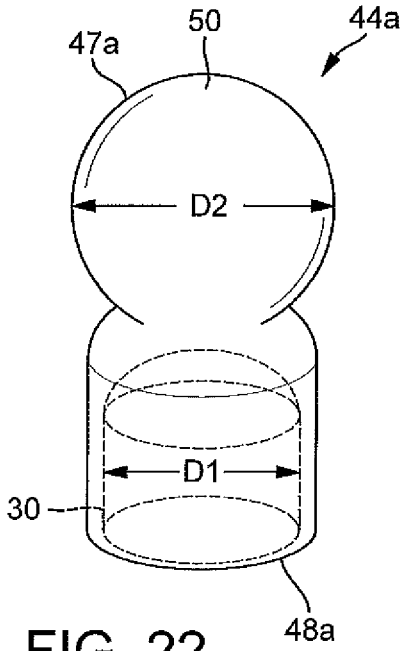
FIG. 22 is a perspective view of a first 2-way coupler included as part of an accessory kit according to an embodiment of the invention.

Referring to FIG. 22, a first 2-way coupler 44*a* is shown having a ball joint 50 formed at a first end 47*a* thereof acting as the first coupling means and an opening 30 formed in the second end 48*a* thereof acting as the second coupling means. The opening 30 has a circular cross-section and extends through at least a portion of the first 2-way coupler 44*a* in a direction from the second end 48*a* of the first 2-way coupler 44*a* toward the first end 47*a* thereof, causing the opening 30 to be substantially cylindrical in shape. The opening 30 has an inner diameter substantially equal to a first diameter D1, where the first diameter D1 is substantially equal to an outer diameter of any of the tubes 12*a*, 12*b*, 12*c*, 14*a*, 14*b*, 14*c*, 14*d*, allowing the opening 30 to receive and retain any of the tubes 12*a*, 12*b*, 12*c*, 14*a*, 14*b*, 14*c*, 14*d* therein. As should be understood, the opening 30 having the first diameter D1 may also be capable of receiving and retaining any component having a suitable outer diameter substantially equal to the first diameter D1. The ball joint 50 has a substantially spherical shape and a maximum diameter substantially equal to a second diameter D2, where the second diameter D2 may be the same as the first diameter D1, larger than the first diameter D1, or smaller than the first diameter D1, as desired.

Figure 23:
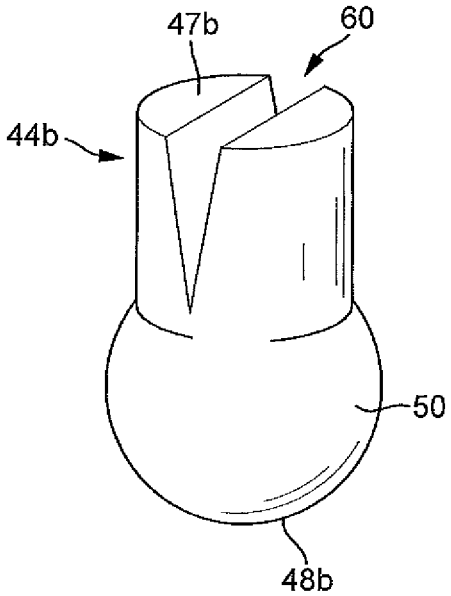
FIG. 23 is a perspective view of a second 2-way coupler included as part of an accessory kit according to an embodiment of the invention.

As shown in FIG. 23, a second 2-way coupler 44*b* includes a slit 60 formed in a first end 47*b* thereof acting as the first coupling means and a ball joint 50 formed in a second end 48*b* thereof acting as the second coupling means. The first end 47*b* may have an outer diameter substantially equal to the first diameter D1, allowing the first end 47*b* of the second 2-way coupler 44*b* having the slit 60 to be received in an opening 30 having an inner diameter substantially equal to the first diameter D1. Because the first end 47*b* of the second 2-way coupler 44*b* may be releasably coupled to any component having one of the openings 30 formed therein, in some embodiments the second 2-way coupler 44*b* may not have the slit 60 formed therein, as desired. The slit 60 extends from the first end 47*b* of the second 2-way coupler 44*b* and toward the second end 48*b* thereof through a cylindrical portion thereof before terminating adjacent the ball joint 50 formed at the second end 48*b* thereof. The slit 60 also extends from one side of the cylindrical portion of the second 2-way coupler 44*b* to an opposite side thereof while passing through a center point of the circular first end 47*b* of the second 2-way coupler 44*b*, effectively dividing the first end 47*b* into two halves. The slit 60 may have a width at the first end 47*b* of the second 2-way coupler 44*b* that decreases as the slit 60 extends toward the second end 48*b* of the second 2-way coupler 44*b*, causing the slit 60 to have a wedge-like shape. In other embodiments, the slit 60 may have a constant width along a length of the slit 60, as desired. The slit 60 should have a width at the first end 47*b* of the second 2-way coupler 44*b* capable of receiving and retaining one of the panels 42*a*, 42*b*, 42*c*, 42*d*, 42*e*, 42*f*, which are described in more detail hereinafter.

Figure 24:
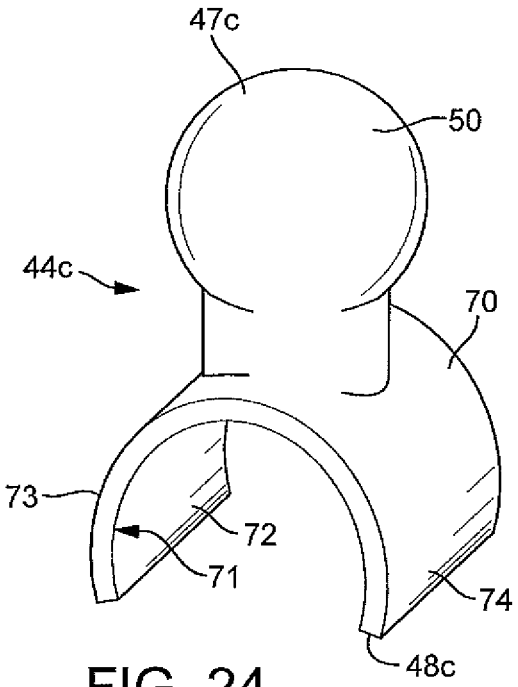
FIG. 24 is a perspective view of a third 2-way coupler included as part of an accessory kit according to an embodiment of the invention.

As shown in FIG. 24, a third 2-way coupler 44*c* includes a ball joint 50 formed at a first end 47*c* thereof acting as the first coupling means and a tube clip 70 formed at the second end 48*c* thereof acting as the second coupling means. The tube clip 70 is a C-shaped clip including a C-shaped channel 71 having a maximum diameter substantially equal to the first diameter D1. The C-shaped channel 71 is formed between a first prong 73 and a second prong 74 of the tube clip 70, wherein each of the first prong 73 and the second prong 74 may be formed from a flexible and resilient material. The C-shaped channel 71 may have a cross-section of a circular arc extending through an angle of curvature slightly greater than 180°, allowing any component having an outer diameter substantially equal to the first diameter D1 to be received and retained within the tube clip 70. Furthermore, the C-shaped channel 71 having an angle of curvature greater than 180° may allow any of the components having an outer diameter substantially equal to the first diameter D1 to "snap-fit" into the C-shaped channel 71 of the tube clip 70 due to the flexible and resilient properties of the first and second prongs 73, 74. The C-shaped channel 71 extends in a first direction causing the tube clip 70 to have an interior surface 72 that is substantially cylindrical and configured to correspond to an exterior surface of any cylindrical component having an outer diameter substantially equal to the first diameter D1, including any of the tubes 12*a*, 12*b*, 12*c*, 14*a*, 14*b*, 14*c*, 14*d*.

Figure 25:
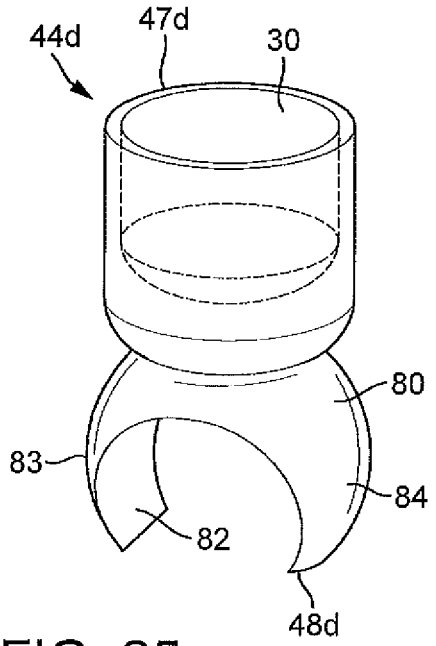
FIG. 25 is a perspective view of a fourth 2-way coupler included as part of an accessory kit according to an embodiment of the invention.

As shown in FIG. 25, a fourth 2-way coupler 44*d* includes an opening 30 formed in a first end 47*d* thereof acting as the first coupling means and a ball joint clip 80 formed in a second end 48*d* thereof acting as the second coupling means. The ball joint clip 80 is similar to the tube clip 70, but the ball joint clip 80 includes an interior surface 82 that has a concave contour corresponding to the spherical exterior surface of the ball joint 50, in contrast to the substantially cylindrical shape of the interior surface 72 of the tube clip 70. At least a portion of the interior surface 82 of the ball joint clip 80 may extend around an angle of curvature greater than 180° to allow the ball joint clip 80 to make a snap-fit connection with the ball joint 50, similar to the fashion in which the tube clip 70 makes a snap-fit connection with one of the tubes 12*a*, 12*b*, 12*c*, 14*a*, 14*b*, 14*c*, 14*d*, for example. The ball joint clip 80 also includes a first prong 83 and a second prong 84. Each of the prongs 83, 84 may widen as each prong 83, 84 extends from a tip thereof toward a region where the prongs 83, 84 meet along the interior surface 82 of the ball joint clip 80. The interior surface 82 of the ball joint clip 80 is configured to fit over and be releasably coupled to the ball joint 50, causing a maximum distance from any point on the interior surface 82 of the ball joint clip 80 to a second point on the interior surface 82 thereof to be substantially equal to the second diameter D2.

Figure 26:
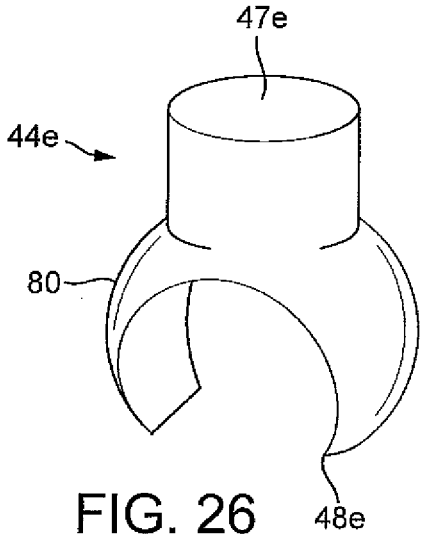
FIG. 26 is a perspective view of a fifth 2-way coupler included as part of an accessory kit according to an embodiment of the invention.

As shown in FIG. 26, a fifth 2-way coupler 44*e* includes a cylindrical first end 47*e* acting as the first coupling means and a ball joint clip 80 formed at a second end 48*e* thereof acting as the second coupling means. The first end 47*e* of the fifth 2-way coupler 44*e* has an outer diameter substantially equal to the first diameter D1, allowing the first end 47*e* to be received in any other component having an opening 30 having an inner diameter substantially equal to the first diameter D1. In some embodiments, the first end 47*e* of the fifth 2-way coupler 44*e* may also include one of the slits 60 formed therein, as desired.

Figure 27:
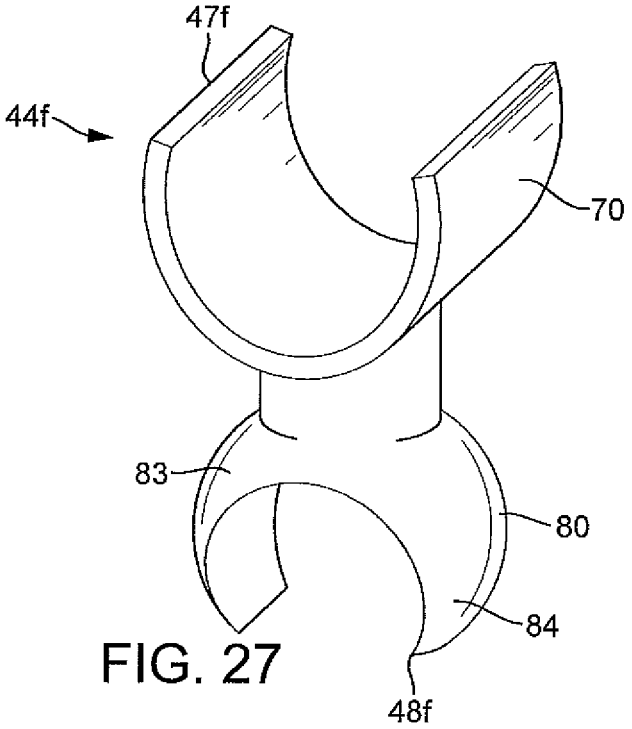
FIG. 27 is a perspective view of a sixth 2-way coupler included as part of an accessory kit according to an embodiment of the invention.

As shown in FIG. 27, a sixth 2-way coupler 44*f* includes a tube clip 70 formed in a first end 47*f* thereof acting as the first coupling means and a ball joint clip 80 formed in a second end 48*f* thereof acting as the second coupling mean. The C-shaped channel 71 formed in the tube clip 70 between the first prong 73 and the second prong 74 may be oriented in parallel to a similarly round opening formed between the first prong 83 and the second prong 84 of the ball joint clip 80. However, it should be understood that the tube clip 70 and the ball joint clip 80 may be oriented relative to each other in any configuration, as desired, due to the flexible nature of the coupling between the ball joint clip 80 and the ball joint 50.

FIGS. 28-34 illustrate several of the 2-way couplers 44*g*, 44*h*, 44*i*, 44*j*, 44*k*, 44*l*, 44*m* having a slit 60 formed in or adjacent at least one of the first end 47 thereof and the second end thereof 48. Each of the slits 60 are configured to receive and retain one of the panels included in the accessory kit.

Figure 28:
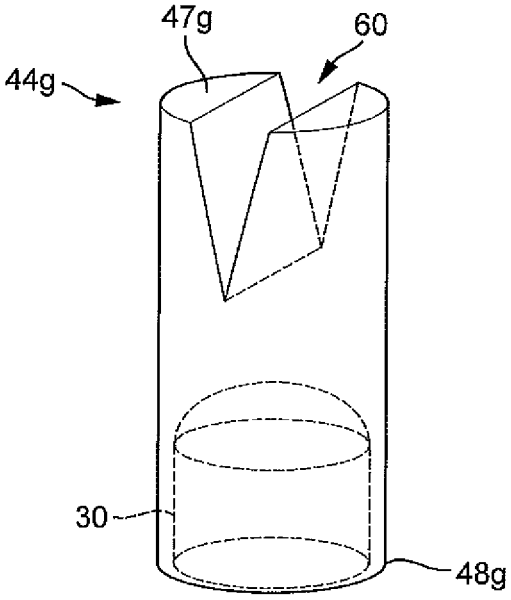
FIG. 28 is a perspective view of a seventh 2-way coupler included as part of an accessory kit according to an embodiment of the invention.

As shown in FIG. 28, a seventh 2-way coupler 44*g* includes a slit 60 formed in a first end 47*g* thereof acting as the first coupling means and an opening 30 formed in a second end 48*g* thereof acting as the second coupling means. The opening 30 has an inner diameter substantially equal to the first diameter D1. The first end 47*g* of the seventh 2-way coupler 44*g* is substantially cylindrical with the exception of the slit 60. The first end 47*g* is shown as having an outer diameter that is larger than the first diameter D1 of the opening 30, but the first end 47*g* of the seventh 2-way coupler may be altered to have an outer diameter substantially equal to the first diameter D1, as desired, to allow the first end 47*g* to be received in any opening having an inner diameter substantially equal to the first diameter D1.

Figure 29:
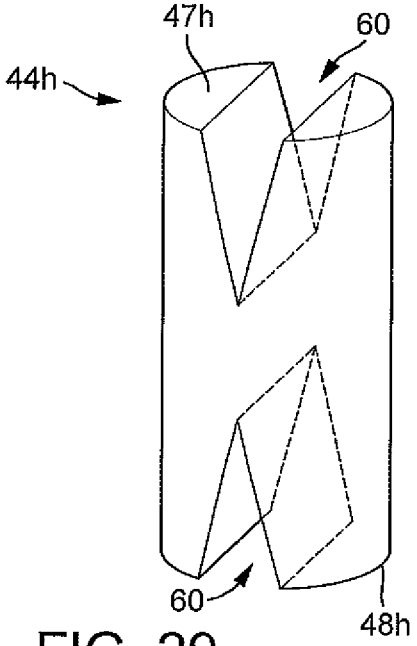
FIG. 29 is a perspective view of an eighth 2-way coupler included as part of an accessory kit according to an embodiment of the invention.
Figure 30:
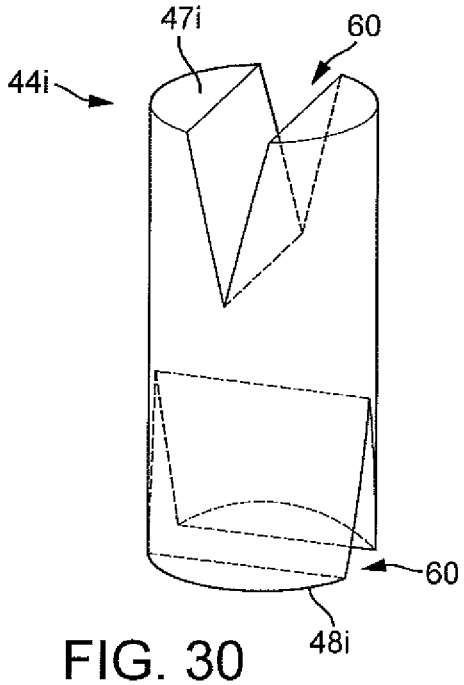
FIG. 30 is a perspective view of a ninth 2-way coupler included as part of an accessory kit according to an embodiment of the invention.

A shown in FIG. 29, an eighth 2-way coupler 44*h* includes a slit 60 formed in a first end 47*h* thereof acting as the first coupling means and a slit 60 formed in a second end 48*h* thereof acting as the second coupling means. FIG. 30 illustrates a ninth 2-way coupler 44*i* having a slit 60 formed in a first end 47*i* thereof acting as the first coupling means and a slit 60 formed in a second end 48*i* thereof acting as the second coupling means. The ninth 2-way coupler 44*i* differs from the eighth 2-way coupler 44*h* in that the slit 60 formed in the first end 47*i* of the ninth 2-way coupler 44*i* is oriented perpendicular to the slit 60 formed in the second end 48*i* thereof, whereas each of the slits 60 formed in the eighth 2-way coupler 44*h* are arranged parallel to each other. Each of the eighth 2-way coupler 44*h* and the ninth 2-way coupler 44*i* are substantially cylindrical and have an outer diameter substantially equal to the first diameter D1, allowing each of the eighth 2-way coupler 44*h* and the ninth 2-way coupler 44*i* to be received in any opening having an inner diameter substantially equal to the first diameter D1, such as the openings 30.

Figure 31:
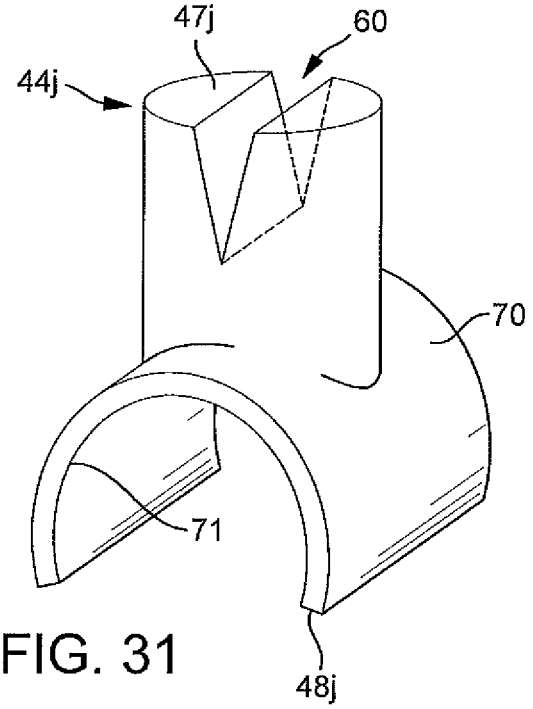
FIG. 31 is a perspective view of a tenth 2-way coupler included as part of an accessory kit according to an embodiment of the invention.
Figure 32:
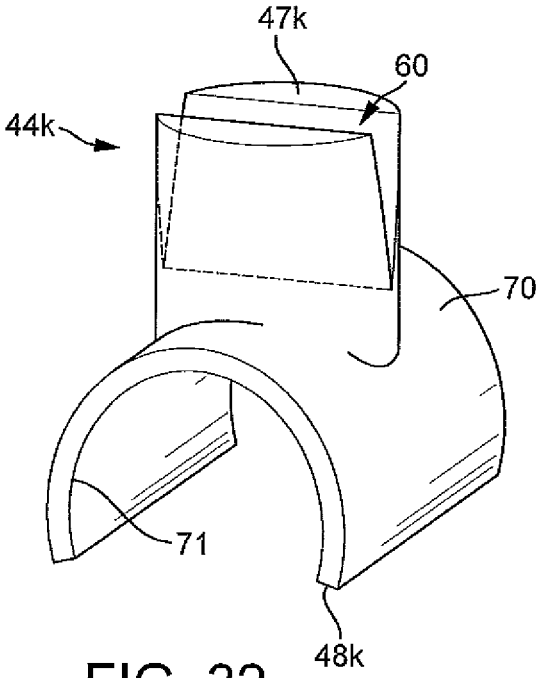
FIG. 32 is a perspective view of an eleventh 2-way coupler included as part of an accessory kit according to an embodiment of the invention.

A shown in FIG. 31, a tenth 2-way coupler 44*j* includes a slit 60 formed in a first end 47*j* thereof acting as the first coupling means and a tube clip 70 formed in a second end 48*j* thereof acting as the second coupling means. FIG. 32 illustrates an eleventh 2-way coupler 44*k* also having a slit 60 formed in a first end 47*k* thereof acting as the first coupling means and a tube clip 70 formed in a second end 48*k* thereof acting as the second coupling means. In the tenth 2-way coupler 44*j*, the C-shaped channel 71 extends from one side of the tenth 2-way coupler 44*j* to an opposite side thereof in the same direction that the slit 60 extends from one side of the tenth 2-way coupler 44*j* to an opposite side thereof. In contrast, the C-shaped channel 71 formed in the eleventh 2-way coupler 44*k* extends through the eleventh 2-way coupler 44*k* in a direction perpendicular to a direction the slit 60 extends from one side of the eleventh 2-way coupler 44*k* to an opposite side thereof. The first end 47*j*, 47*k* of each of the tenth 2-way coupler 44*j* and the eleventh 2-way coupler 44*k* has an outer diameter substantially equal to the first diameter D1, allowing the tenth 2-way coupler 44*j* and the eleventh 2-way coupler 44*k* to be received in an opening having an inner diameter substantially equal to the first diameter D1, such as the openings 30.

Figure 33:
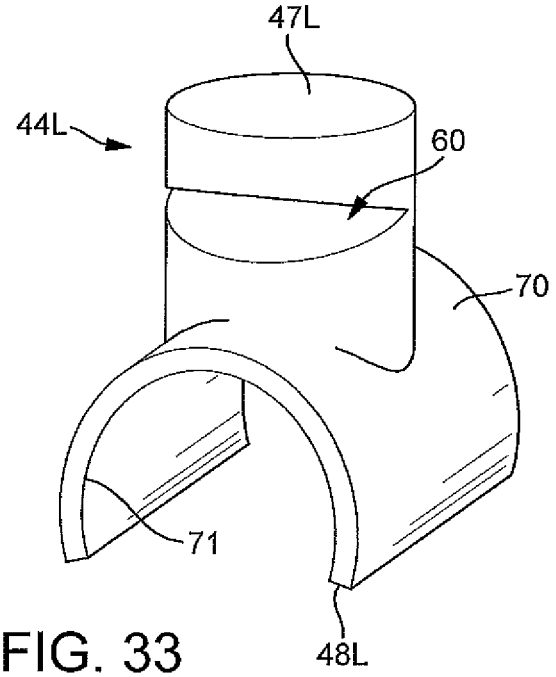
FIG. 33 is a perspective view of a twelfth 2-way coupler included as part of an accessory kit according to an embodiment of the invention.
Figure 34:
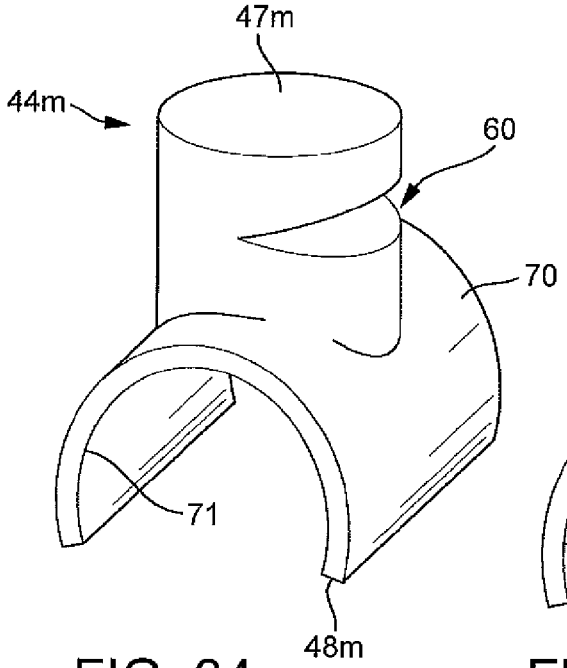
FIG. 34 is a perspective view of a thirteenth 2-way coupler included as part of an accessory kit according to an embodiment of the invention.

As shown in FIG. 33, a twelfth 2-way coupler 44*l* includes a slit 60 formed adjacent and spaced apart from a first end 47*l* thereof acting as the first coupling means and a tube clip 70 formed in a second end 48*l* thereof acting as the second coupling means. FIG. 34 illustrates a thirteenth 2-way coupler 44*m* having a slit 60 formed adjacent and spaced apart from a first end 47*m* thereof acting as the first coupling means and a tube clip 70 formed in a second end 48*m* thereof acting as the second coupling means. The slits 60 are formed in a direction parallel to a surface forming the first ends 47*l*, 47*m* of each of the twelfth 2-way coupler 44*l* and the thirteenth 2-way coupler 44*m*, respectively. The slit 60 formed in the twelfth 2-way coupler 44*l* extends from one side of a cylindrical portion of the twelfth 2-way coupler 44*l* and toward an opposite side, terminating at an edge about halfway through the twelfth 2-way coupler 44*l* to cause the slit 60 to be semi-circular and wedge-like in shape. The slit 60 formed in the twelfth 2-way coupler 44*l* is arranged to receive one of the panels 42 in the same direction that the C-shaped channel 71 of the tube clip 70 extends from one side of the twelfth 2-way coupler 44*l* to an opposite side thereof. The thirteenth 2-way coupler 44*m* also includes a semi-circular wedge-like slit 60, but the slit 60 formed in the thirteenth 2-way coupler 44*m* extends in a direction perpendicular to the slit 60 formed in the twelfth 2-way coupler 44*l* relative to the tube clip 70, allowing the thirteenth 2-way coupler 44*m* to receive a panel 42 in a direction perpendicular to a direction that the C-shaped channel 71 formed in the tube clip 70 extends from one side of the thirteenth 2-way coupler 44*m* to an opposite side thereof. Additionally, the first end 47*l*, 47*m* of each 2-way coupler 44*l*, 44*m* may have an outer diameter substantially equal to the first diameter D1, allowing the first end 47*l*, 47*m* of each respective 2-way coupler 44*l*, 44*m* to be received in one of the openings 30 having the inner diameter substantially equal to the first diameter D1.

Figure 35:
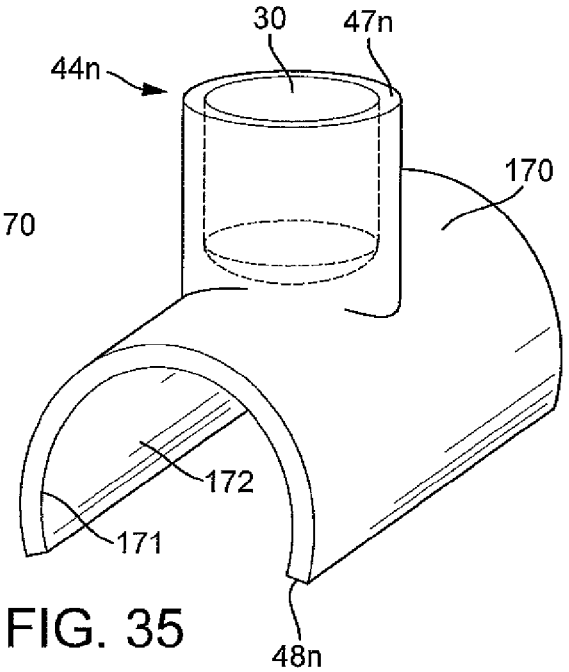
FIG. 35 is a perspective view of a fourteenth 2-way coupler included as part of an accessory kit according to an embodiment of the invention.

FIGS. 35-38 illustrate several 2-way couplers 44*n*, 44*o*, 44*p*, 44*q* that may be used to form a variety of hinge mechanisms. FIG. 35 illustrates a fourteenth 2-way coupler 44*n* having an opening 30 formed in a first end 47*n* thereof acting as the first coupling means and a tube clip 170 formed in a second end 48*n* thereof acting as the second coupling means. The opening 30 formed in the first end 47*n* has an inner diameter substantially equal to the first diameter D1. The tube clip 170 differs from the tube clip 70 in that the tube clip 170 has a greater length measured from one end of a C-shaped channel 171 to a second end of the C-shaped channel 171. For instance, the length of the tube clip 170 may be about twice a length of the tube clip 70 in some embodiments. The extended length of the tube clip 170 allows the tube clip 170 to better act as a hinge mechanism because the extended length provides added stability and reduces undesired mobility of the tube clip 170 during use thereof due to the increased surface area between an interior surface 172 of the tube clip 170 and any cylindrical component to which it is releasably coupled.

Figure 36:
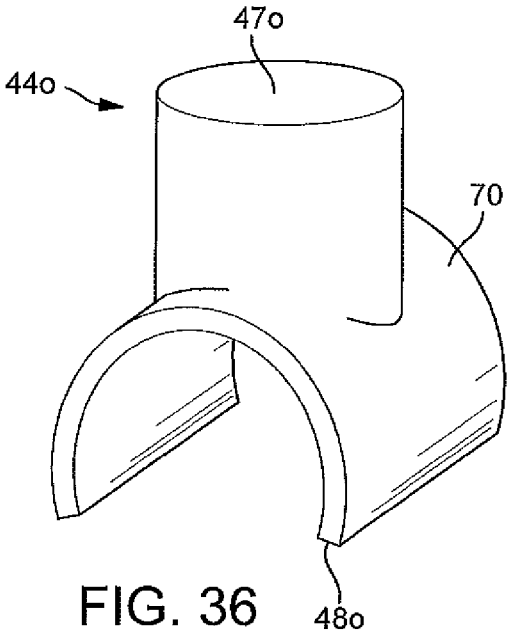
FIG. 36 is a perspective view of a fifteenth 2-way coupler included as part of an accessory kit according to an embodiment of the invention.

As shown in FIG. 36, a fifteenth 2-way coupler 44*o* includes a cylindrical portion with an outer diameter substantially equal to the first diameter D1 formed at a first end 47*o* thereof acting as the first coupling means and a tube clip 70 formed in a second end 48*o* thereof acting as the second coupling means. The fifteenth 2-way coupler 44*o* may be used in conjunction with the fourteenth 2-way coupler 44*n* to form a completed hinge mechanism, as the cylindrical portion of the fifteenth 2-way coupler 44*o* may be received in the opening 30 of the fourteenth 2-way coupler 44*n* in any number of orientations to cause the C-shaped channel 71 formed in the tube clip 70 to be arranged at different orientations relative to the C-shaped channel 171 formed in the tube clip 170.

Figure 37:
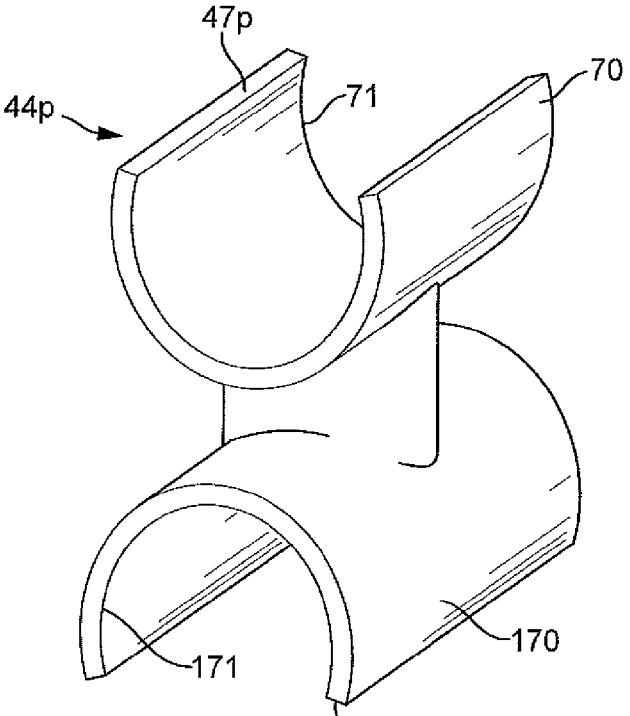
FIG. 37 is a perspective view of a sixteenth 2-way coupler included as part of an accessory kit according to an embodiment of the invention.
Figure 38:
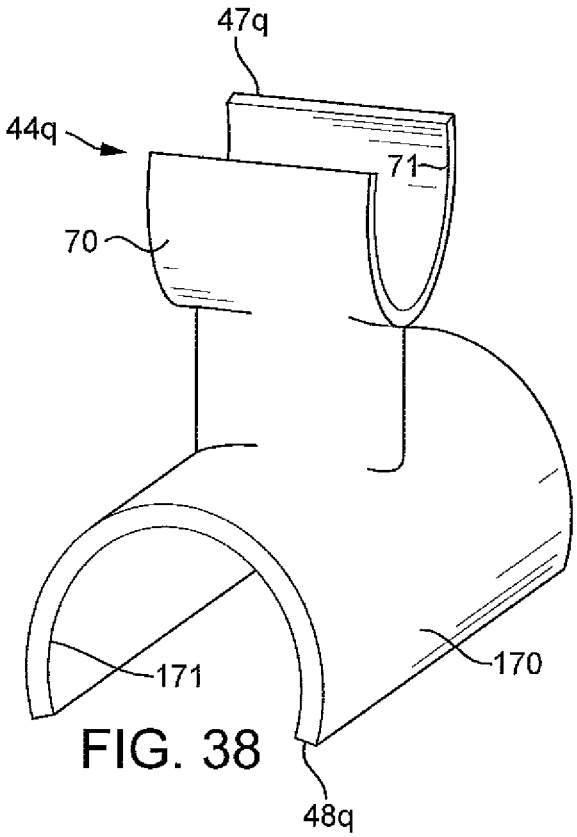
FIG. 38 is a perspective view of a seventeenth 2-way coupler included as part of an accessory kit according to an embodiment of the invention.

As shown in FIG. 37, a sixteenth 2-way coupler 44*p* includes a tube clip 70 formed in a first end 47*p* thereof acting as the first coupling means and a tube clip 170 having the increased length formed at a second end 48*p* thereof acting as the second coupling means. FIG. 38 illustrates a seventeenth 2-way coupler 44*q* having a tube clip 70 formed in a first end 47*q* thereof acting as the first coupling means and a tube clip 170 having the increased length formed at a second end 48*q* thereof acting as the second coupling means. In the sixteenth 2-way coupler 44*p*, the C-shaped channel 71 formed in the tube clip 70 and the C-shaped channel 171 formed in the tube clip 170 extend in the same direction through the sixteenth 2-way coupler 44*p*. In contrast, the seventeenth 2-way coupler 44*q* includes a C-shaped channel 71 formed in the tube clip 70 extending in a direction perpendicular to a direction the C-shaped channel 171 formed in the tube clip 170 extends.

Referring now to FIGS. 39-48, several different examples of effects couplers 144*a*, 144*b*, 144*c*, 144*d*, 144*e*, 144*f*, 144*g*, 144*h*, 144*i*, 144*j* are shown, where the effects couplers 144*a*, 144*b*, 144*c*, 144*d*, 144*e*, 144*f*, 144*g*, 144*h*, 144*i*, 144*j* are similar in construction to the 2-way couplers 44*a*, 44*b*, 44*c*, 44*d*, 44*e*, 44*f*, 44*g*, 44*h*, 44*i*, 44*j*, 44*k*, 44*l*, 44*m*, 44*n*, 44*o*, 44*p*, 44*q* while also including at least one of a light source 37 and an audio source 38 formed therein or coupled thereto. The light source 37 is used to illuminate any of the components forming the kit 10 or the kit 40 including the panels 42. The light source 37 may be any form of light generating device, such as an LED light. The light source 37 may include a power source (not shown) and an activating device (not shown) to selectively cause the light source 37 to emit light therefrom. The audio source 38 is used to play any form of sound effects or music that may be suitable for use with any of the play structures 100, 100', 200, 200', 300, 300', 400, 400', 500, 500', 600, 600', 700, 700', 800, 800', 900, 900', 1000, 1100 that may be assembled using the kit 10. The audio source 38 may produce sounds using mechanical means or electronic means. If electronic means are used, the audio source 38 may include a memory (not shown) for storing any recorded sounds, a processor (not shown) configured to read the memory, a digital-to-analog converter (not shown) to convert the digitally stored sound to an analog signal, an amplifier (not shown), and a speaker. The audio source 38 may include an activating device (not shown) to selectively cause the audio source 38 to emit sound therefrom. Any other known audio sources 38 may be used, as desired. Each of the light source 37 and the audio source 38 may be manually operated by a user or the light source 37 and the audio source 38 may be configured to be activated automatically in response to a specified condition being met.

Figure 39:
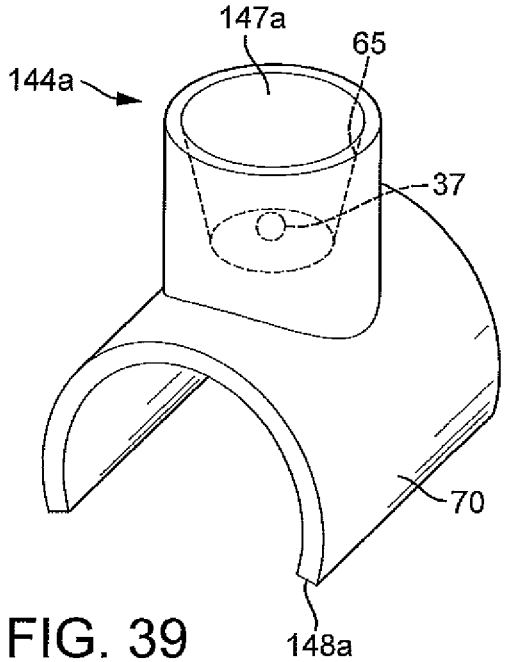
FIG. 39 is a perspective view of a first effects coupler included as part of an accessory kit according to an embodiment of the invention.

As shown in FIG. 39, a first effects coupler 144*a* includes a depression 65 formed in a first end 147*a* thereof and a tube clip 70 formed in a second end 148*a* thereof. A light source 37 is disposed within the depression 65 and emits light that extends out from the depression 65. The depression 65 may have a substantially conical shape as shown, but it should be understood that the depression 65 may have any shape suitable for housing the light source 37, including cylindrical. The conical shape of the depression 65 may aid the light being emitting from the light source 37 to exit the depression 65 and expand similar to the light of a flash-light, for example. The cylindrical first end 147*a* of the first effects coupler 144*a* may have an outer diameter substantially equal to the first diameter D1.

Figure 40:
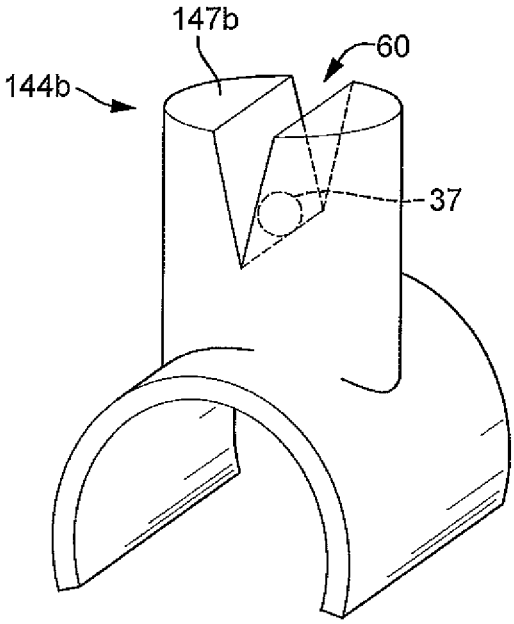
FIG. 40 is a perspective view of a second effects coupler included as part of an accessory kit according to an embodiment of the invention.
Figure 41:
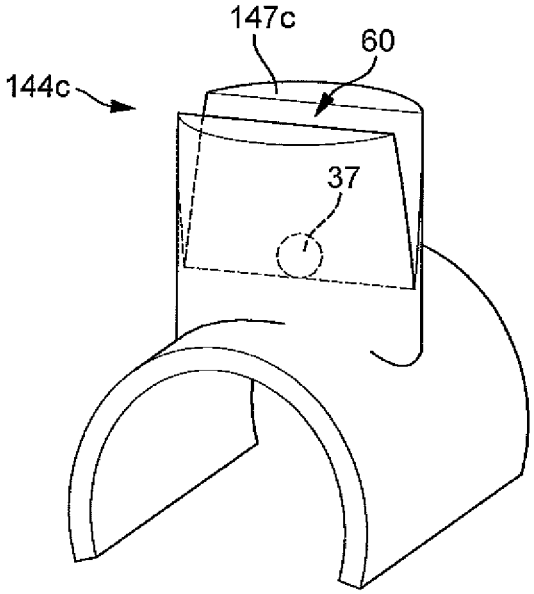
FIG. 41 is a perspective view of a third effects coupler included as part of an accessory kit according to an embodiment of the invention.

As shown in FIG. 40, a second effects coupler 144*b* includes nearly identical structure to the tenth 2-way coupler 44*j* except for the addition of a light source 37 disposed at a base of the slit 60 formed in a first end 147*b* thereof. The wedge-like shape of the slit 60 may aid the light being emitted from the light source 37 to exit the slit 60 and expand outwardly in a fan-like configuration. Similarly, FIG. 41 illustrates a third effects coupler 144*c* having nearly identical structure to the eleventh 2-way coupler 44*k* except for the addition of a light source 37 disposed at a base of the slit 60 formed in the first end 147*c* thereof.

Figure 42:
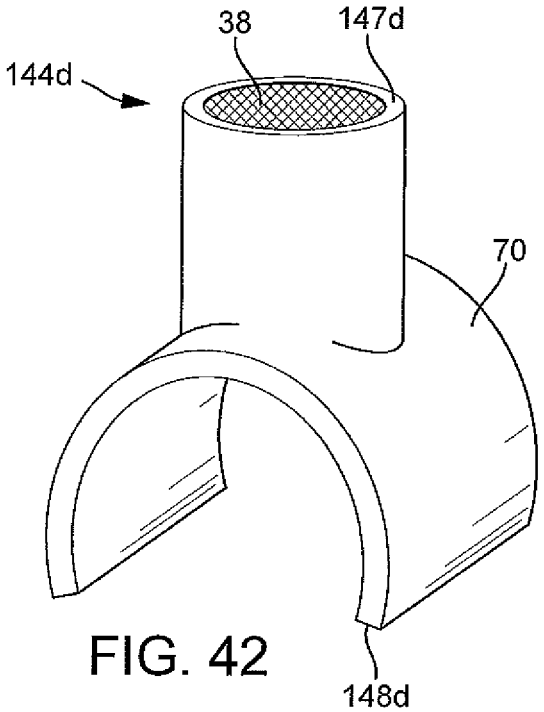
FIG. 42 is a perspective view of a fourth effects coupler included as part of an accessory kit according to an embodiment of the invention.

As shown in FIG. 42, a fourth effects coupler 144*d* includes an audio source 38 formed in a cylindrical first end 147*d* thereof and a tube clip 70 formed in a second end 148*d* thereof. The audio source 38 may be disposed within an opening formed in the first end 147*d* or the audio source 38 may be disposed on and coupled to the first end 147*d*, as desired. The first end 147*d* of the fourth effects coupler 144*d* may have an outer diameter substantially equal to the first diameter D1.

Figure 43:
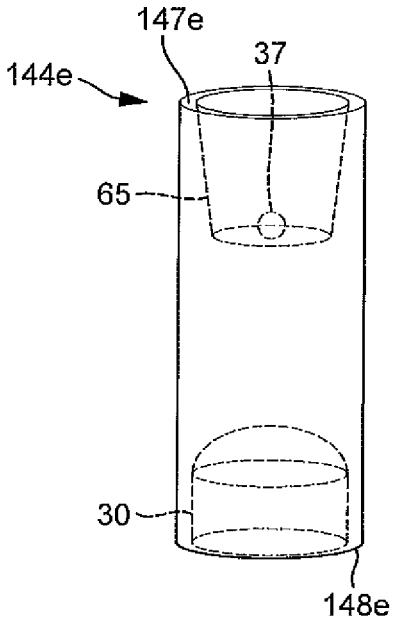
FIG. 43 is a perspective view of a fifth effects coupler included as part of an accessory kit according to an embodiment of the invention.

As shown in FIG. 43, a fifth effects coupler 144*e* includes a depression 65 with a light source 37 disposed therein formed at a first end 147*e* thereof and an opening 30 formed at a second end 148*e* thereof, where the opening 30 has an inner diameter substantially equal to the first diameter D1.

Figure 44:
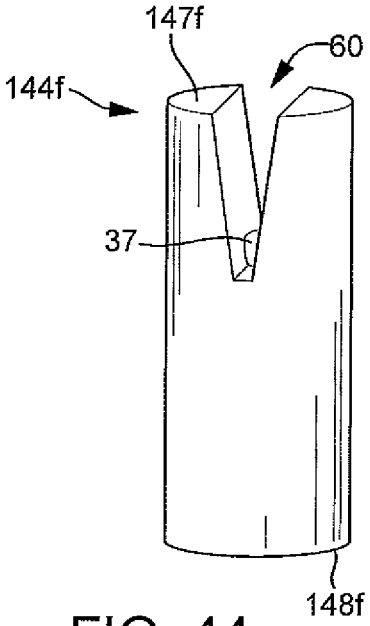
FIG. 44 is a perspective view of a sixth effects coupler included as part of an accessory kit according to an embodiment of the invention.

A shown in FIG. 44, a sixth effects coupler 144*f* includes a cylindrical first end 147*f* and a cylindrical second end 148*f*. Each of the first end 147*f* and the second end 148*f* has an outer diameter substantially equal to the first diameter D1, allowing either end 147*f*, 148*f* to be received in any opening having an inner diameter substantially equal to the first diameter D1, such as the openings 30. The first end 147*f* of the sixth effects coupler 144*f* also includes a slit 60 having a light source 37 disposed therein.

Figure 45:
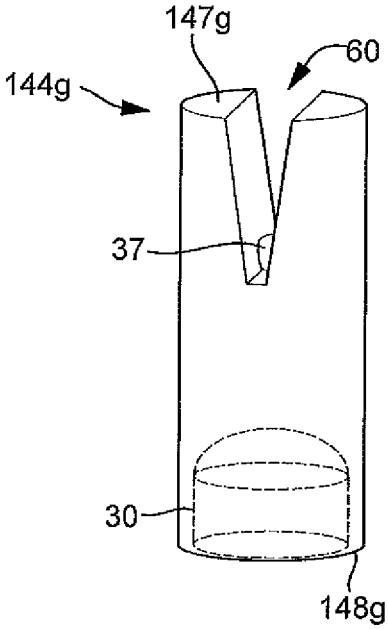
FIG. 45 is a perspective view of a seventh effects coupler included as part of an accessory kit according to an embodiment of the invention.

As shown in FIG. 45, a seventh effects coupler 144*g* includes nearly identical structure to the seventh 2-way coupler 44*g*, except the slit 60 formed in a first end 147*g* of the seventh effects coupler 144*g* includes a light source 37 disposed therein.

Figure 46:
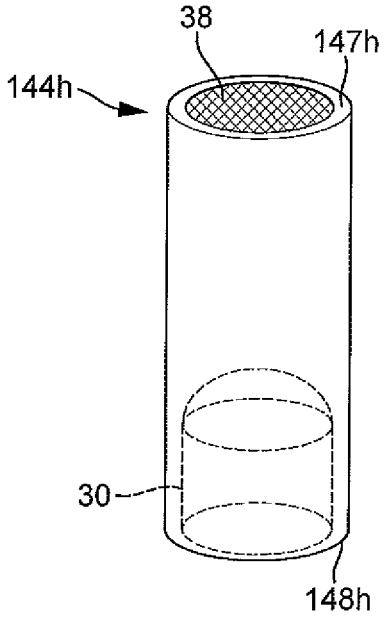
FIG. 46 is a perspective view of an eighth effects coupler included as part of an accessory kit according to an embodiment of the invention.

As shown in FIG. 46, an eighth effects coupler 144*h* includes an audio source 38 formed in a cylindrical first end 147*h* thereof and an opening 30 formed in a second end 148*h* thereof, where the opening 30 has an inner diameter substantially equal to the first diameter D1. Although the eighth effects coupler 144*h* is shown as having a consistent outer diameter throughout a length thereof, it should be understood that the first end 147*h* and the second end 148*h* thereof may be adapted to have different outer diameters, including the first end 147*h* having an outer diameter substantially equal to or different from the first diameter D1. If the first end 147*h* has an outer diameter substantially equal to the first diameter D1, the first end 147*h* may be received in one of the openings 30.

Figure 47:
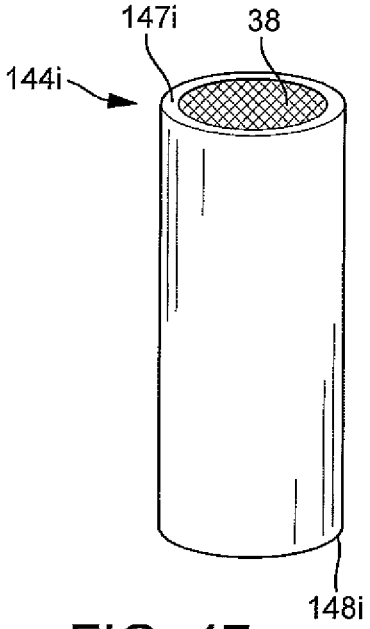
FIG. 47 is a perspective view of a ninth effects coupler included as part of an accessory kit according to an embodiment of the invention.

As shown in FIG. 47, a ninth effects coupler 144*i* is substantially cylindrical as the ninth effects coupler 144*i* extends from a first end 147*i* thereof to a second end 148*i* thereof. The first end 147*i* of the ninth effects coupler 144*i* includes an audio source 38 formed or disposed therein. In some embodiments, an outer diameter of the ninth effects coupler 144*i* may be substantially equal to the first diameter D1 along a length of the ninth effects coupler 144*i*, allowing either end 147*i*, 148*i* of the ninth effects coupler 144*i* to be received within any opening having an inner diameter substantially equal to the first diameter D1, such as the openings 30. However, in other embodiments, the ninth effects coupler 144*i* may have an outer diameter different from the first diameter D1.

Figure 48:
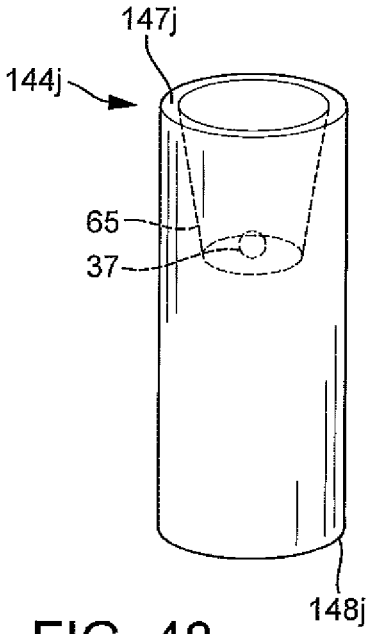
FIG. 48 is a perspective view of a tenth effects coupler included as part of an accessory kit according to an embodiment of the invention.

As shown in FIG. 48, a tenth effects coupler 144*j* includes a depression 65 with a light source 37 disposed therein formed at a first end 147*j* thereof and a cylindrical portion having an outer diameter substantially equal to the first diameter D1 formed at a second end 148*j* thereof. The second end 148*j* of the tenth effects coupler 144*j* may accordingly be received in any opening having an inner diameter substantially equal to the first diameter D1, such as the openings 30.

However, in some embodiments, the tenth effects coupler 144*j* may have an outer diameter different from the first diameter D1, as desired.

Figure 49:
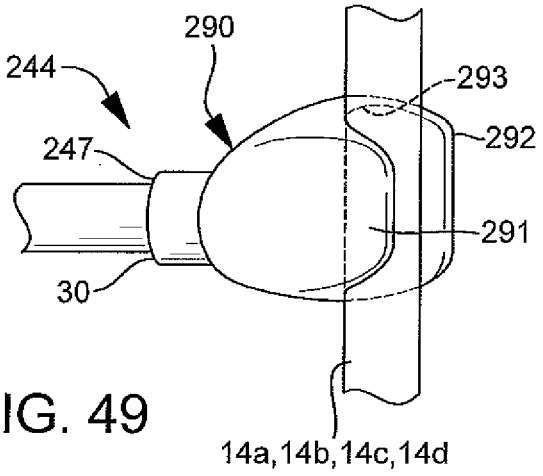
FIG. 49 is a perspective view of a hand coupler included as part of an accessory kit according to an embodiment of the invention.
Figure 50:
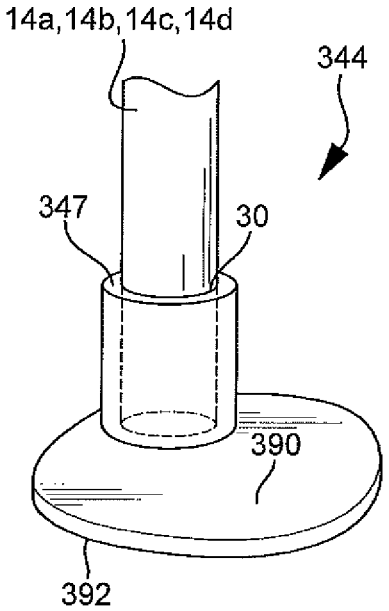
FIG. 50 is a perspective view of a foot coupler included as part of an accessory kit according to an embodiment of the invention.

Referring now to FIGS. 49 and 50, the accessory kit may further include a hand coupler 244 and a foot coupler 344. The hand coupler 244 includes an opening 30 formed in a first end 247 thereof having an inner diameter substantially equal to the first diameter D1. The hand coupler 244 further includes a body portion 290 that has a shape similar to a shape of a mitten, including a thumb portion 291 and a finger portion 292 that cooperate to form a substantially cylindrical opening 293 therebetween, where the cylindrical opening 293 has a maximum diameter substantially equal to the first diameter D1. In similar fashion to the tube clip 70, an interior surface 294 of the hand coupler 244 forming the cylindrical opening 293 may extend around an angle of curvature slightly greater than 180° to allow any component having an outer diameter substantially equal to the first diameter D1 to be retained within the cylindrical opening 293 after being received therein, such as by a snap-fit connection. As shown in FIG. 49, the thumb portion 291 may have a smaller width in a direction the cylindrical opening 293 extends through the hand coupler 244 than does the finger portion 292 thereof to give the hand coupler 244 a more hand-like appearance. The foot coupler 344 includes a cylindrical first end 347 having an opening 30 formed therein having an inner diameter substantially equal to the first diameter D1 for receiving any component having an outer diameter substantially equal to the first diameter D1. An end of the cylindrical portion of the foot coupler 344 opposite the opening 30 includes an elongated body portion 390 including a substantially planar surface 392. The cylindrical portion of the foot coupler 344 may be coupled to the body portion 390 adjacent one end thereof to give the foot coupler 344 more of a foot-like appearance.

It should be understood that any of the 2-way couplers 44*a*, 44*b*, 44*c*, 44*d*, 44*e*, 44*f*, 44*g*, 44*h*, 44*i*, 44*j*, 44*k*, 44*l*, 44*m*, 44*n*, 44*o*, 44*p*, 44*q* or the effects couplers 144*a*, 144*b*, 144*c*, 144*d*, 144*e*, 144*f*, 144*g*, 144*h*, 144*i*, 144*j* may be modified such that the first coupling means and the second coupling means of each coupler may include any of the features described hereinabove, allowing for any combination of the features described hereinabove, as desired.

Referring now to FIGS. 51-55, several examples of the panels 42*a*, 42*b*, 42*c*, 42*d*, 42*e* are shown. The panels 42*a*, 42*b*, 42*c*, 42*d*, 42*e* may be substantially planar or may include any number of contoured or curved surfaces, as desired. The panels 42*a*, 42*b*, 42*c*, 42*d*, 42*e* may also have any shape and size, as desired, including panels that are circular, semi-circular, triangular, and rectangular, for example. The panels 42*a*, 42*b*, 42*c*, 42*d*, 42*e* may be substantially rigid or the panels 42*a*, 42*b*, 42*c*, 42*d*, 42*e* may be flexible and capable of being manipulated to alternative forms. The panels 42*a*, 42*b*, 42*c*, 42*d*, 42*e* may be formed from any suitable material, including any suitable form of rubber or plastic. The panels 42*a*, 42*b*, 42*c*, 42*d*, 42*e* may further include at least one decorative feature 43 formed thereon, allowing the panels 42*a*, 42*b*, 42*c*, 42*d*, 42*e* to represent a wide variety of different objects or characters, as desired. The decorative features 43 included on the panels may enhance imaginative, interactive play of a child with the play structure and role playing by the child inside the play structure itself. It should be understood that the panels 42*a*, 42*b*, 42*c*, 42*d*, 42*e* shown in FIGS. 51-55 are non-limiting examples, as the variety of different themes offered by the variety of different play structures 100, 100', 200, 200', 300, 300', 400, 400', 500, 500', 600, 600', 700, 700', 800, 800', 900, 900', 1000, 1100 allows for panels having any suitable shape, size, and appearance, in addition to the panels 42*a*, 42*b*, 42*c*, 42*d*, 42*e* shown and described herein. For example, the accessory kit may include a plurality of panels having a common theme, including a set of panels depicting a building or structure, an automobile, an airplane, a water craft, a person, or an animal, for example.

The panels 42*a*, 42*b*, 42*c*, 42*d*, 42*e* are configured to be received in any of the slits 60 formed in any of the 2-way couplers 44*b*, 44*e*, 44*g*, 44*h*, 44*i*, 44*j*, 44*k*, 44*l*, 44*m* or the effects couplers 144*b*, 144*c*, 144*f*, 144*g*. Accordingly, the panels 42*a*, 42*b*, 42*c*, 42*d*, 42*e* may be selected to have a thickness substantially equal to or slightly less than a maximum width of any of the slits 60. Because the slits 60 may be formed to have a wedge-like shape, with a decreasing width as the slits 60 extend into an interior of either of the 2-way couplers 44*b*, 44*e*, 44*g*, 44*h*, 44*i*, 44*j*, 44*k*, 44*l*, 44*m* or the effects couplers 144*b*, 144*c*, 144*f*, 144*g*, the panels 42*a*, 42*b*, 42*c*, 42*d*, 42*e* may be retained within the slits 60 by pressing the panels 42*a*, 42*b*, 42*c*, 42*d*, 42*e* into the slits 60 until the decreasing width of the slits 60 compresses the panels 42*a*, 42*b*, 42*c*, 42*d*, 42*e* to retain them within the slits 60.

Figure 51:
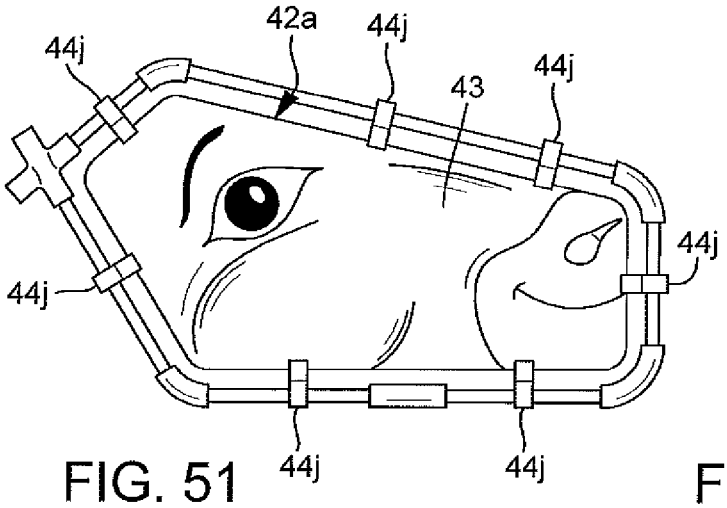
FIG. 51 is a front elevational view of a first panel included as part of an accessory kit according to an embodiment of the invention.

As shown in FIG. 51, a first panel 42*a* includes a decorative feature 43 formed thereon graphically representing a face of a horse. In other embodiments, the decorative feature 43 may depict a face of a dragon or a unicorn, as non-limiting examples. The first panels 42*a* is shown as being retained to a frame by a plurality of the tenth 2-way couplers 44*j* disposed around a periphery of the frame. Referring back to FIGS. 16 and 17, the covering 24 included on the play structure 800' may accordingly be replaced with the first panel 42*a* as an alternative option for decorating the horse-themed play structure 800.

Figure 52:
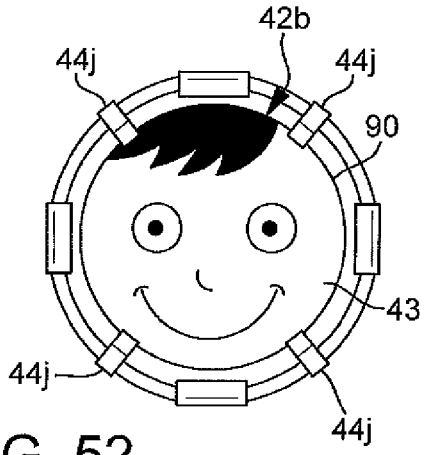
FIG. 52 is a front elevational view of a second panel included as part of an accessory kit according to an embodiment of the invention.

As shown in FIG. 52, a second panel 42*b* includes a substantially circular shape, including a non-linear edge 90 formed around a periphery thereof. The second panel 42*b* further includes a decorative feature 43 formed thereon graphically representing a face of a boy. In other embodiments, the decorative feature 43 may depict a face of a girl or a face of a super-hero character, as non-limiting examples. The second panel 42*b* is also shown as being retained to a frame by a plurality of the tenth 2-way couplers 44*j*. Referring back to FIG. 20, a portion of the frame 1002 of the play structure 1000 depicting a human head may be replaced by the frame having the second panel 42*b* coupled thereto as an alternative option in constructing the play structure 1000.

Figure 53:
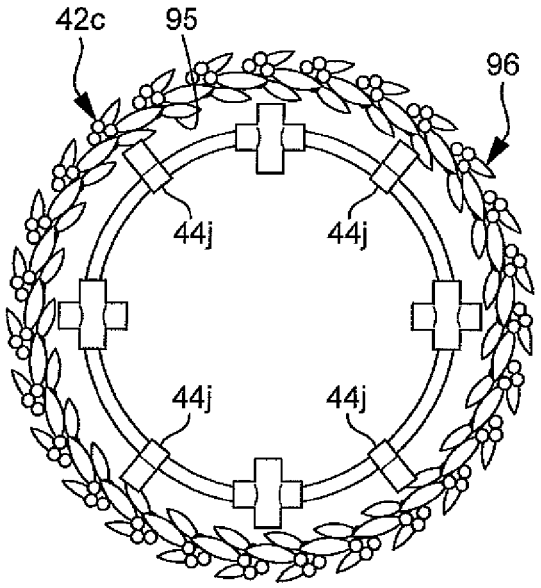
FIG. 53 is a front elevational view of a third panel included as part of an accessory kit according to an embodiment of the invention.

As shown in FIG. 53, a third panel 42*c* includes a substantially circular aperture 95 formed therein. The aperture 95 allows for the third panel 42*c* to be placed around and coupled to a peripheral edge of a structure or frame formed using the kit 10 and the accessory kit. The third panel 42*c* further includes an irregular edge 96 formed both on an outer peripheral edge of the third panel 42*c* and along an edge defining the aperture 95. The irregular edge 96 forming the aperture 95 is retained to a frame using a plurality of the tenth 2-way couplers 44*j*. The third panel 42*c* includes a decorative feature 43 formed thereon graphically representing a wreath. In other embodiments, the decorative feature 43 having the opening 95 may represent trim for surrounding a structure created using the kit 10, as a non-limiting example. It should be understood that the opening 95 may have any shape, including elliptical, triangular, and rectangular, for example, depending on the application for which the third panel 42*c* is being used.

Figure 54:
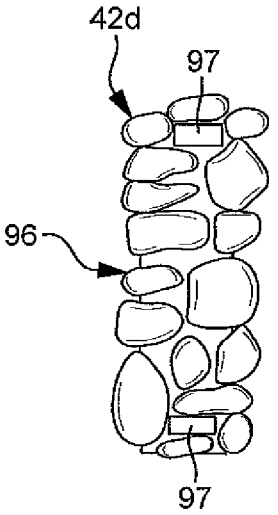
FIG. 54 is a front elevational view of a fourth panel included as part of an accessory kit according to an embodiment of the invention.

As shown in FIG. 54, a fourth panel 42*d* is elongated in one direction and may include an aperture in a form of a slot 97 formed adjacent each end thereof. The slot 97 is configured to provide an interior edge for connecting the fourth panel 42*d* to a coupler such as the twelfth 2-way coupler 44*l*. The fourth panel 42*d* also includes an irregular edge 96. The fourth panel 42*d* includes a decorative feature 43 graphically representing a brick arrangement. In other embodiments, the decorative feature 43*d* may represent a linear arrangement of flowers, a linear arrangement of stones, and a linearly oriented flower box, as non-limiting examples. The fourth panel 42*d* may have any suitable length, as desired. The fourth panel 42*d* may, for instance, have a length substantially equal to 24 inches, as a non-limiting example.

Figure 55:
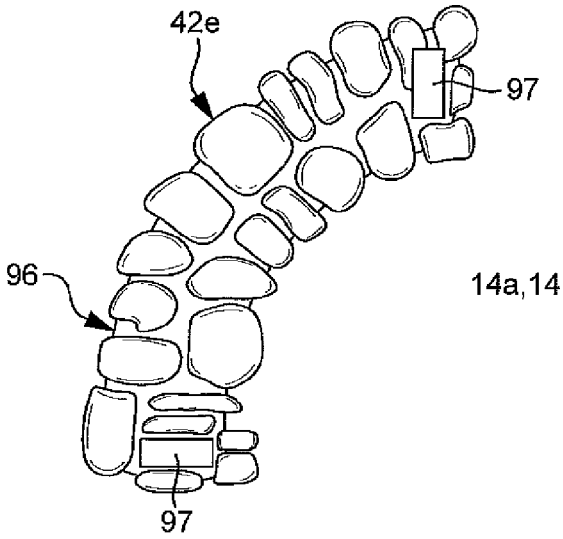
FIG. 55 is a front elevational view of a fifth panel included as part of an accessory kit according to an embodiment of the invention.

As shown in FIG. 55, a fifth panel 42*e* is arcuate in shape and includes an angle of curvature of about 90°. The fifth panel 42*e* may also include a pair of the slots 97 formed at each end thereof and the fifth panel 42*e* also includes an irregular edge 96. The fifth panel 42*e* includes a decorative feature 43 formed thereon graphically representing an arched brick arrangement. In other embodiments, the decorative feature 43 may represent an arched arrangement of stones or flowers, as non-limiting examples. It should be understood that the fifth panel 42*e* may be formed to extend around any angle of curvature, including 45°, 135°, or 180°, as non-limiting examples.

Figure 56:
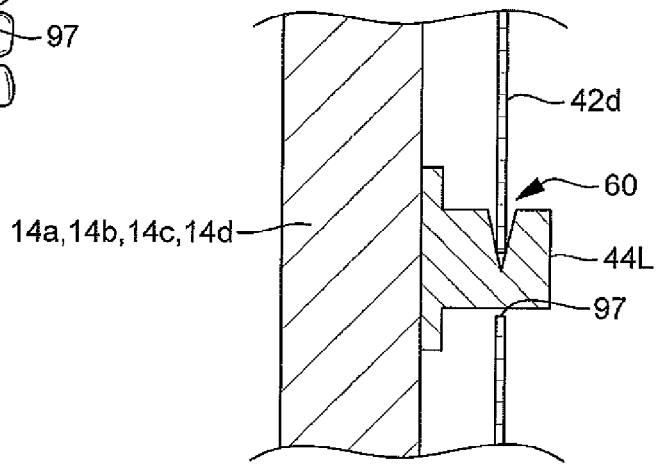
FIG. 56 is a cross-sectional elevational view of the fourth panel illustrated in FIG. 54 while releasably coupled to the twelfth 2-way coupler illustrated in FIG. 33.

As shown in FIG. 56, the first end 47*l* of the twelfth 2-way coupler 44*l* may be inserted through the slot 97 formed in the fourth panel 42*d* until the interior edge forming the slot 97 can be inserted into the slit 60 formed in the twelfth 2-way coupler 44*l*. The fourth panel 42*d* is then able to be arranged in parallel to a surface of any of the tubes 12*a*, 12*b*, 12*c*, 14*a*, 14*b*, 14*c*, 14*d* to which it may be indirectly coupled without requiring access to a peripheral edge of any of the panels 42*a*, 42*b*, 42*c*, 42*d*, 42*e*.

Figure 57:
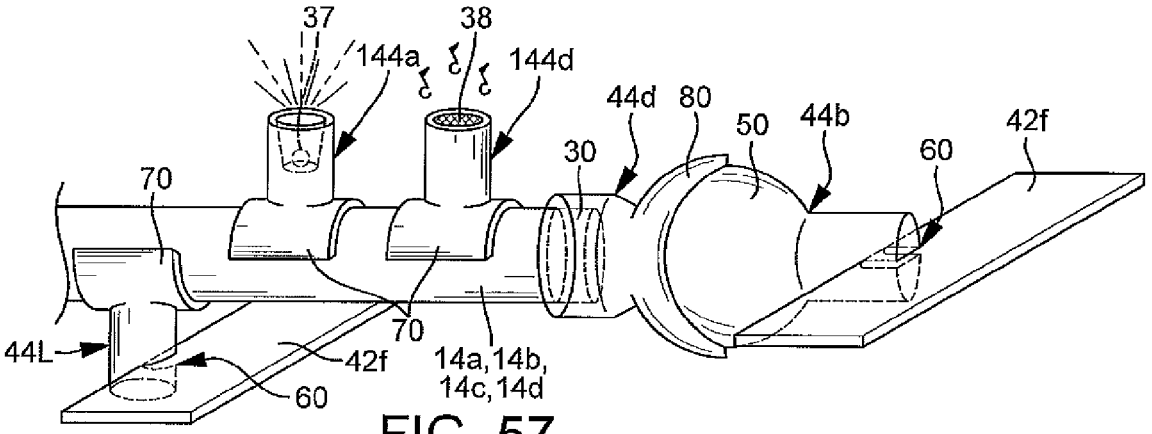
FIG. 57 is a perspective view showing a linear tube having a variety of different 2-way and effects couplers releasably coupled thereto.

FIG. 57 illustrates several methods of coupling the various components included in the kit 10 or the accessory kit to one another to produce a play structure such as the play structures 100, 100', 200, 200', 300, 300', 400, 400', 500, 500', 600, 600', 700, 700', 800, 800', 900, 900', 1000, 1100. The twelfth 2-way coupler 44*l*, the first effects coupler 144*a*, and the fourth effects coupler 144*d* are shown as being releasably coupled to one of the plurality of linear tubes 14*a*, 14*b*, 14*c*, 14*d* by means of a snap-fit connection between the C-shaped channel 71 formed in the tube clip 70 of each respective coupler 44*l*, 144*a*, 144*d* and an exterior surface of the linear tube 14*a*, 14*b*, 14*c*, 14*d*. The twelfth 2-way coupler 44*l* is also releasably coupled to a rectangular sixth panel 42*f* that is retained within the slit 60 formed adjacent the first end 47*l* of the twelfth 2-way coupler 44*l*. The arrangement of the slit 60 allows the sixth panel 42*f* to be arranged in a direction parallel to a direction the linear tube 14*a*, 14*b*, 14*c*, 14*d* extends. The first effects coupler 144*a* is shown as emitting light from the light source 37, while the fourth effects coupler 144*d* is shown as emitting sound from the audio source 38. An end of the linear tube 14*a*, 14*b*, 14*c*, 14*d* is shown as having a fourth 2-way coupler 44*d* disposed thereon. The fourth 2-way coupler 44*d* receives the end of the linear tube 14*a*, 14*b*, 14*c*, 14*d* within the opening 30 formed in the first end 47*d* of the fourth 2-way coupler 44*d* to releasably couple the fourth 2-way coupler 44*d* to the linear tube 14*a*, 14*b*, 14*c*, 14*d*. The ball joint clip 80 formed at a second end 48*d* of the fourth 2-way coupler 44*d* receives a ball joint 50 formed at the second end 48*b* of the second 2-way coupler 44*b* to releasably couple the fourth 2-way coupler 44*d* to the second 2-way coupler 44*b*. The coupling of the ball joint clip 80 to the ball joint 50 allows for a greater degree of freedom of movement of the second 2-way coupler 44*b* relative to the fourth 2-way coupler 44*d* than does a traditional hinged coupling. The first end 47*b* of the second 2-way coupler 44*b* also includes a slit 60 formed therein having another of the rectangular sixth panels 42*f* releasably retained therein. It should be understood that the methods of releasably coupling the couplers 44*b*, 44*d*, 44*l*, 144*a*, 144*d* shown in FIG. 57 apply to each coupler having similar structure. It should also be understood that any of the couplers included in the accessory kit may be releasably coupled to one of the arcuate tubes 12*a*, 12*b*, 12*c* in addition to the linear tubes 14*a*, 14*b*, 14*c*, 14*d*, as desired.

Referring now to FIGS. 58-62, the accessory kit may further include a plurality of fabric couplers 444*a*, 444*b* and a plurality of fabric panels 442. The fabric panels 442 may be formed from any flexible cloth-like material. The fabric panels 442 may be formed from a fabric comprised of naturally occurring fibers or the fabric panels 442 may be formed from a synthetic fabric, such as polyester, acrylic, nylon, or spandex, as non-limiting examples.

Figure 58:
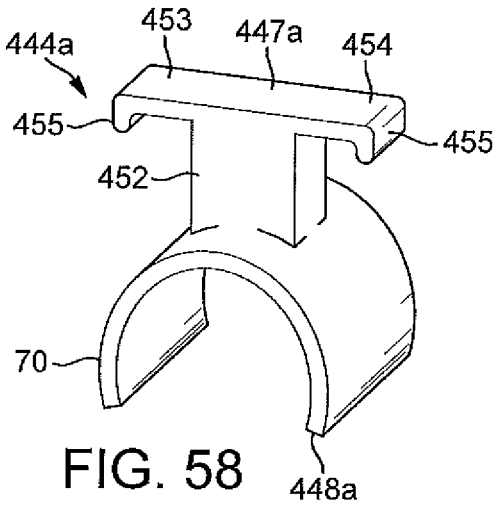
FIG. 58 is a perspective view of a first fabric coupler included as part of an accessory kit according to an embodiment of the invention.

As shown in FIG. 58, a first fabric coupler 444*a* includes a projection 452 formed in a first end 447*a* thereof and a tube clip 70 formed at the second end 448*a* thereof, where the tube clip 70 has an inner diameter substantially equal to the first diameter D1. The projection 452 extends away from the tube clip 70 in a direction extending from the second end 448*a* of the first fabric coupler 444*a* toward the first end 447*a* thereof, allowing the projection 452 to extend perpendicularly from any tube 12*a*, 12*b*, 12*c*, 14*a*, 14*b*, 14*c*, 14*d* to which the tube clip 70 of the first fabric coupler 444*a* may be releasably coupled. The projection 452 further includes a first flange member 453 extending from one side thereof and a second flange member 454 extending from a second opposite side thereof. Each of the first flange member 453 and the second flange member 454 may include a protuberance 455 extending in a direction toward the tube clip 70 formed at a distal end of each respective flange member 453, 454. The projection 452 is shown as having a substantially rectangular shape in FIG. 58, but the projection 452 may have any shape, as desired. In some embodiments, the projection 452 may include a central shaft portion connecting the tube clip 70 to a circular or oval shaped flange portion, for example, giving the projection 452 a substantially button-like appearance.

Figure 59:
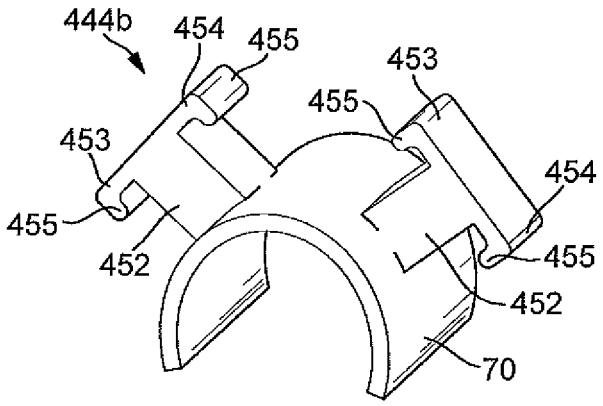
FIG. 59 is a perspective view of a second fabric coupler included as part of an accessory kit according to an embodiment of the invention.

A shown in FIG. 59, a second fabric coupler 444*b* includes a pair of the projections 452 formed thereon as well as a tube clip 70. Each of the projections 452 has the same structure as the projection 452 formed on the first fabric coupler 444*a*. As shown in FIG. 59, the projections 452 extend away from the tube clip 70 in two different directions arranged substantially perpendicular to each other.

Figure 60:
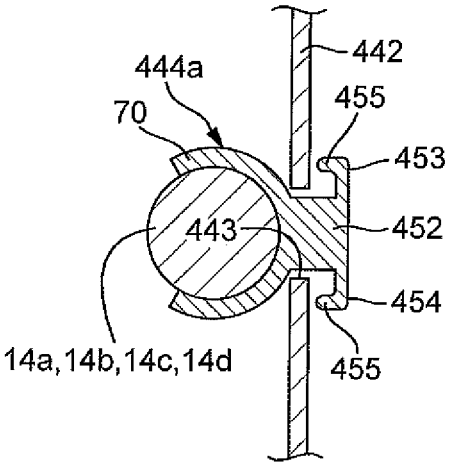
FIG. 60 is a cross-sectional elevational view of the first fabric coupler illustrated in FIG. 58 when releasably coupled to a fabric panel.
Figure 61:
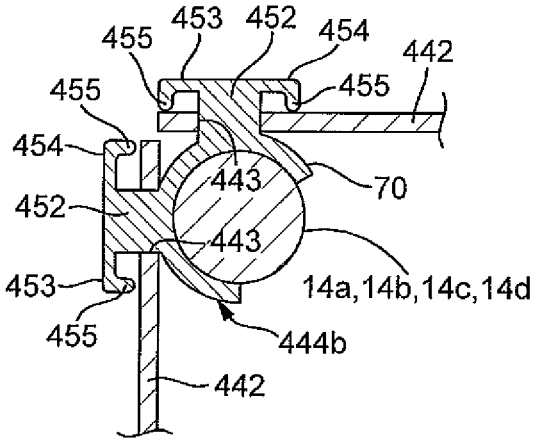
FIG. 61 is a cross-sectional elevational view of the second fabric coupler illustrated in FIG. 59 when releasably coupled to a fabric panel.

FIGS. 60 and 61 illustrate the first and second fabric coupler 444*a*, 444*b* when releasably coupled to one of the fabric panels 442. In FIG. 60, the projection 452 formed on the first fabric coupler 444*a* is inserted through a slot 443 formed in the fabric panel 442. The flexible nature of the fabric panel 442 allows the projection 452 to fit through the slot 443 despite the slot 443 normally having an opening smaller than the projection 452. The first fabric coupler 444*a* accordingly operates similar to a button, as once the projection 452 extends past the slot 443 the first and second flange members 453, 454 aid in retaining the first fabric coupler 444*a* within the slot 443. As described hereinabove, the projection 452 having the substantially circular or oval shaped portion may also function similar to a button when inserted through one of the slots 443. Accordingly, it should be understood that the projection 452 may have any shape capable of being retained within one of the slots 443 after the projection 452 has been inserted therethrough. FIG. 61 similarly illustrates the second fabric coupler 444*b* while being retained in a pair of slots 443 formed in two separates fabric panels 442. The second fabric coupler 444*b* accordingly allows for a pair of fabric panels 442 joined at about a 90° angle to be releasably coupled to a single one of the second fabric couplers 444*b* simultaneously.

Figure 62:
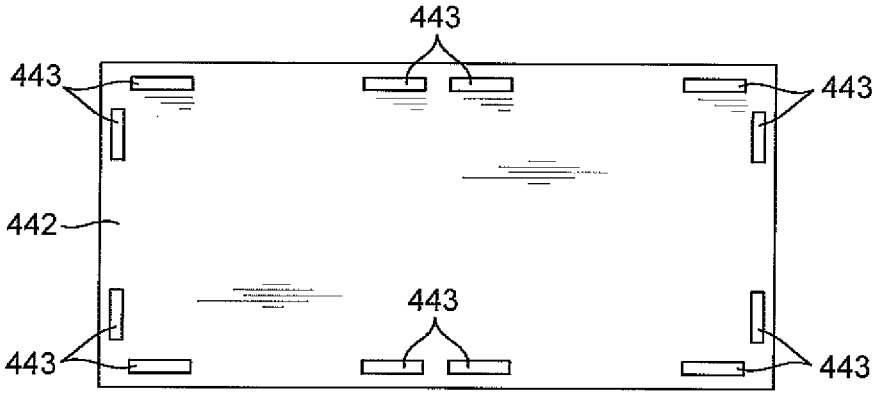
FIG. 62 is a front elevational view of a fabric panel having a plurality of slots formed therein according to an embodiment of the invention.

FIG. 62 illustrates an example of one of the fabric panels 442. The fabric panel 442 is substantially rectangular in shape and includes twelve (12) of the slots 443 formed around a peripheral edge thereof. It should be understood, however, that the fabric panels 442 may have any shape or size, and may include any number of the slots 443 necessary to releasably couple the fabric panel 442 to any suitable structure formed with the kit 10. Referring back to FIG. 7, an uppermost portion of the play structure 300' having the reference numeral 24 pointing thereto may be suitable for having the fabric panel 442 depicted in FIG. 62 releasably coupled thereto, as the fabric panel 442 includes a pair of the slots 443 corresponding to each 6-way connector 16*a* disposed along the uppermost surface of the play structure 300'.

The accessory kit may be packaged to include any combination of the plurality of 2-way couplers 44*a*, 44*b*, 44*c*, 44*d*, 44*e*, 44*f*, 44*g*, 44*h*, 44*i*, 44*j*, 44*k*, 44*l*, 44*m*, 44*n*, 44*o*, 44*p*, 44*q* the plurality of effects couplers 144*a*, 144*b*, 144*c*, 144*d*, 144*e*, 144*f*, 144*g*, 144*h*, 144*i*, 144*j*, the hand coupler 244, the foot coupler 344, the fabric couplers 444*a*, 444*b*, the panels 42*a*, 42*b*, 42*c*, 42*d*, 42*e* and the fabric panels 442. The accessory kit may further include an instruction manual similar to the instruction manual 20, where the instruction manual provides instructions on how to assemble the components included in the accessory kit or the kit 10. The accessory kit advantageously allows a user to customize a play structure such as the play structures 100, 100', 200, 200', 300, 300', 400, 400', 500, 500', 600, 600', 700, 700', 800, 800', 900, 900', 1000, 1100 with a greater degree of freedom than is offered in the prior art solutions. The components included in the accessory kit allow for a nearly limitless combination of components to create play structures of variable sizes and shapes that have greater flexibility of design, including the use of components having non-linear edges and multiple different coupling means.

From the foregoing description, one ordinarily skilled in the art can easily ascertain the essential characteristics of this invention and, without departing from the spirit and scope thereof, make various changes and modifications to the invention to adapt it to various usages and conditions.

What is claimed is:

1. An accessory kit for a play structure for a child, the accessory kit comprising:

a plurality of panels, the plurality of panels including a first solid panel having a non-linear edge; and a plurality of couplers, the plurality of couplers including a first coupler having a C-shaped tube clip formed in a first end thereof, the C-shaped tube clip having a C-shaped channel formed therein configured to releasably couple the first coupler to an exterior surface of a tube, wherein a second end of the first coupler extends away from the C-shaped tube clip in a direction perpendicular to a direction the C-shaped channel extends through the C-shaped tube clip.

2. The accessory kit according to claim 1, wherein the second end of the first coupler has an opening formed therein, wherein the opening is substantially cylindrical in shape and configured to releasably couple the first coupler to an end of a cylindrical component.

3. The accessory kit according to claim 1, wherein the second end of the first coupler includes a substantially spherical ball joint formed therein, wherein the ball joint is configured to releasably couple the first coupler to a ball joint clip having an interior surface substantially corresponding to an exterior surface of the ball joint.

4. The accessory kit according to claim 1, wherein the second end of the first coupler includes a slit formed therein, wherein the slit is configured to receive an edge of one of the plurality of panels therein to releasably couple the first coupler to the one of the panels.

5. The accessory kit according to claim 4, wherein the slit includes a light source disposed therein.

6. The accessory kit according to claim 4, wherein the slit extends into the second end of the first coupler in a direction parallel to the direction the C-shaped channel extends through the C-shaped tube clip formed in the first end of the first coupler.

7. The accessory kit according to claim 4, wherein the slit extends into the second end of the first coupler in a direction perpendicular to the direction the C-shaped channel extends through the C-shaped tube clip formed in the first end of the first coupler.

8. The accessory kit according to claim 1, wherein the second end of the first coupler includes a ball joint clip formed therein, wherein the ball joint clip has an interior surface configured to receive a substantially spherical ball joint therein to releasably couple the first coupler to the ball joint.

9. The accessory kit according to claim 1, wherein the second end of the first coupler includes one of a light source and an audio source disposed therein.

10. The accessory kit according to claim 1, wherein the second end of the first coupler includes a projection formed therein, wherein the projection includes a first flange member extending from one side thereof and a second flange member extending from a second side thereof.

11. The accessory kit according to claim 10, wherein the second end of the first coupler further includes a second projection formed therein extending from the C-shaped tube clip in a direction perpendicular to a direction the first projection extends from the tube clip.

12. The accessory kit according to claim 1, wherein the plurality of couplers includes a second coupler having a cylindrical first end with a slit formed therein extending in a direction toward a second end of the second coupler, wherein the cylindrical first end of the second coupler is configured to be received in a cylindrical opening and the slit is configured to receive an edge of one of the plurality of panels therein.

13. The accessory kit according to claim 12, wherein the second end of the second coupler includes one of a substantially spherical ball joint formed therein;

an opening formed therein configured to receive a substantially cylindrical component therein;

a second slit formed therein arranged in parallel to the slit formed in the first end of the second coupler; and a second slit formed therein arranged perpendicular to the slit formed in the first end of the second coupler.

14. The accessory kit according to claim 1, wherein the plurality of couplers includes a second coupler having an opening formed in a first end thereof configured to receive a cylindrical component therein.

15. The accessory kit according to claim 14, wherein the second end of the second coupler includes one of:

a substantially spherical ball joint formed therein;

a ball joint clip formed therein configured to receive the ball joint; and a slit formed therein configured to receive an edge of one of the plurality of panels.

16. The accessory kit according to claim 1, wherein the plurality of panels includes a second panel having an aperture formed therein, the aperture defining an interior edge of the second panel.

17. The accessory kit according to claim 16, wherein the second panel is formed from a flexible material and the aperture formed therein is configured to receive and retain a portion of one of the plurality of couplers therein to releasably couple the second panel to the one of the plurality of couplers.

18. The accessory kit according to claim 1, wherein the plurality of panels further includes:

a second panel having an aperture formed therein;

a third panel having an arcuate shape; and a fourth panel having an irregularly shaped peripheral edge.

19. The accessory kit according to claim 1, wherein the plurality of couplers includes:

a second coupler having a substantially spherical ball joint formed in a first end thereof;

a third coupler having a ball joint clip formed in a first end thereof, wherein the ball joint clip is configured to be releasably coupled to the ball joint of the second coupler;

a fourth coupler having an opening formed in a first end thereof, wherein the opening is configured to receive a substantially cylindrical component therein; and a fifth coupler having a slit formed in a first end thereof, the slit configured to receive an edge of one of the plurality of panels.

20. The accessory kit according to claim 1, wherein the second end of the first coupler has another C-shaped tube clip formed therein, the another C-shaped tube clip having another C-shaped channel formed therein configured to releasably couple the first coupler to an exterior surface of another tube.

21. The accessory kit according to claim 20, wherein the C-shaped channel is larger than the another C-shaped channel.

22. The accessory kit according to claim 20, wherein the C-shaped channel and the another C-shaped channel are parallel.

23. The accessory kit according to claim 20, wherein the C-shaped channel and the another C-shaped channel are perpendicular.

24. A kit for constructing a variety of play structures for a child, the kit comprising:

a plurality of arcuate first tubes;

a plurality of arcuate second tubes, wherein at least one of the arcuate first tubes and the arcuate second tubes is substantially rigid;

a plurality of linear tubes, wherein the linear tubes are substantially rigid;

a plurality of connectors, the connectors including a 6-way tube connector, a 3-way tube connector, a 90-degree tube connector, a 45-degree tube connector, and a coupling tube connector, the connectors configured for releasably assembling at least one of the arcuate first tubes, the arcuate second tubes, and the linear tubes together with another one of the arcuate first tubes, the arcuate second tubes, and the linear tubes to form a variety of frames for the variety of play structures;

a plurality of panels, the plurality of panels including a first panel having a non-linear edge; and a plurality of couplers, the plurality of couplers including a first coupler having a C-shaped tube clip formed in a first end thereof, the C-shaped tube clip having a C-shaped channel formed therein configured to releasably couple the first coupler to an exterior surface of one of the arcuate first tubes, the arcuate second tubes, and the linear tubes, wherein a second end of the first coupler extends away from the C-shaped tube clip in a direction perpendicular to a direction the C-shaped channel extends through the C-shaped tube clip;

wherein at least one of the frames is configured to fit the child inside the frame.

25. A method of constructing a play structure comprising the steps of:

providing a kit including a plurality of arcuate first tubes, a plurality of arcuate second tubes, wherein at least one of the arcuate first tubes and the arcuate second tubes is substantially rigid, and a plurality of linear tubes, wherein the linear tubes are substantially rigid;

providing an accessory kit including a plurality of panels and a plurality of couplers, the plurality of panels including a first solid panel having a non-linear edge and the plurality of couplers including a first coupler having a C-shaped tube clip formed in a first end thereof, the C-shaped tube clip having a C-shaped channel formed therein configured to releasably couple the first coupler to an exterior surface of one of the arcuate first tubes, the arcuate second tubes, and the linear tubes, wherein a second end of the first coupler extends away from the C-shaped tube clip in a direction perpendicular to a direction the C-shaped channel extends through the C-shaped tube clip;

releasably assembling at least one of the arcuate first tubes, the arcuate second tubes, and the linear tubes together with another one of the arcuate first tubes, the arcuate second tubes, and the linear tubes to form a frame of the play structure; and releasably coupling the first coupler to at least one of the arcuate first tubes, the arcuate second tubes, and the linear tubes.

26. The method according to claim 25, further including a step of releasably coupling the first coupler to at least one of the plurality of panels.

27. The method according to claim 25, wherein the releasable assembling of at least one of the arcuate first tubes, the arcuate second tubes, and the linear together with another one of the arcuate first tubes, the arcuate second tubes, and the linear tubes is performed using the first coupler.

28. A method of constructing a play structure comprising the steps of providing a plurality of tubes, a plurality of connectors, a plurality of panels, and a plurality of couplers including a first coupler having a first end configured for releasably coupling to one of the tubes and a second end configured for releasably coupling to one of the panels, wherein the first coupler has a C-shaped tube clip formed in the first end thereof, the C-shaped tube clip having a C-shaped channel formed therein configured to releasably couple the first coupler to an exterior surface of one of the tubes, wherein the second end of the first coupler extends away from the C-shaped tube clip in a direction perpendicular to a direction the C-shaped channel extends through the C-shaped tube clip;

releasably assembling at least one of the tubes with another one of the tubes using one of the connectors to form a frame of the play structure;

releasably coupling the first end of the first coupler to one of the tubes; and releasably coupling the second end of the first coupler to one of the panels.

29. The method according to claim 28, wherein the plurality of tubes includes a plurality of arcuate first tubes, a plurality of arcuate second tubes, wherein at least one of the arcuate first tubes and the arcuate second tubes is substantially rigid, and a plurality of linear tubes, wherein the linear tubes are substantially rigid.

30. The method according to claim 28, wherein the plurality of panels includes a first solid panel.

31. The method according to claim 28, wherein the plurality of panels includes a first panel having a non-linear edge.

32. The method according to claim 28, wherein the second end of the first coupler includes a slit.

33. The method according to claim 28, wherein the frame of the play structure is configured to fit a child inside the frame.

* * * * *